US011145480B2

(12) United States Patent
Yoneda

(10) Patent No.: US 11,145,480 B2
(45) Date of Patent: Oct. 12, 2021

(54) FUSE DEVICE

(71) Applicant: DEXERIALS CORPORATION, Tokyo (JP)

(72) Inventor: Yoshihiro Yoneda, Tochigi (JP)

(73) Assignee: DEXERIALS CORPORATION, Tokyo (JP)

( * ) Notice: Subject to any disclaimer, the term of this patent is extended or adjusted under 35 U.S.C. 154(b) by 0 days.

(21) Appl. No.: 16/485,339

(22) PCT Filed: Feb. 13, 2018

(86) PCT No.: PCT/JP2018/004922

§ 371 (c)(1),
(2) Date: Aug. 12, 2019

(87) PCT Pub. No.: WO2018/159283

PCT Pub. Date: Sep. 7, 2018

(65) Prior Publication Data

US 2020/0006030 A1 Jan. 2, 2020

(30) Foreign Application Priority Data

Feb. 28, 2017 (JP) ..... JP2017-037574
Apr. 18, 2017 (JP) ..... JP2017-082025
Feb. 5, 2018 (JP) ..... JP2018-018293

(51) Int. Cl.
*H01H 85/175* (2006.01)
*H01H 85/08* (2006.01)
(Continued)

(52) U.S. Cl.
CPC .... *H01H 85/1755* (2013.01); *H01H 85/0052* (2013.01); *H01H 85/0411* (2013.01);
(Continued)

(58) Field of Classification Search
CPC .... H01H 85/1755; H01H 85/08; H01H 85/06; H01H 85/0411; H01H 85/143;
(Continued)

(56) References Cited

U.S. PATENT DOCUMENTS 2,911,504 A * 11/1959 Cohn ..... H01H 85/06 337/296
4,320,374 A * 3/1982 Narancic ..... H01H 85/06 337/162
(Continued)

FOREIGN PATENT DOCUMENTS

CN 106349688 A 1/2017
EP 0016467 A1 * 10/1980 ..... H01H 85/055
(Continued)

OTHER PUBLICATIONS

Aug. 13, 2020, Korean Office Action issued for related KR application No. 10-2019-7023110.
(Continued)

*Primary Examiner* — Anatoly Vortman
(74) *Attorney, Agent, or Firm* — Paratus Law Group, PLLC

(57) ABSTRACT

Provided is a fuse device used for high rating and high current applications excellent in impact resistance at the time of current interruption, and capable of preventing falling off of the case. The fuse device includes: a base member; a cover member fitted to the base member and covering a surface of the base member; and a fuse element mounted on the surface of the base member; wherein one of the base member and the cover member is provided with a side wall intersecting with the plane of the surface of the base member and including an opening formed therein, and the other of the base member and the cover member is provided with a fitting projection projecting outward from a
(Continued)

plane intersecting with the plane of the surface of the base member and fitted into the opening of the side wall.

11 Claims, 23 Drawing Sheets

(51) Int. Cl.
*H01H 85/06* (2006.01)
*H01H 85/17* (2006.01)
*H01H 85/143* (2006.01)
*H01H 85/00* (2006.01)
*H01H 85/041* (2006.01)

(52) U.S. Cl.
CPC ..... *H01H 85/06* (2013.01); *H01H 85/08* (2013.01); *H01H 85/143* (2013.01); *H01H 85/17* (2013.01); *H01H 2085/0414* (2013.01)

(58) Field of Classification Search
CPC ..... H01H 85/0052; H01H 85/17; H01H 2085/0414; H01H 85/175; H01H 2085/0412
USPC ..... 337/183
See application file for complete search history.

(56) References Cited

U.S. PATENT DOCUMENTS 4,511,875 A * 4/1985 Arikawa ..... H01H 85/0411 337/186
4,608,548 A * 8/1986 Borzoni ..... H01H 85/0417 337/186
4,670,729 A * 6/1987 Oh ..... H01H 85/0417 337/262
4,837,546 A * 6/1989 Bernstein ..... H01H 85/044 337/201
4,894,633 A * 1/1990 Holtfreter ..... H01H 85/0411 337/201
5,162,773 A * 11/1992 Shiozaki ..... H01H 85/0411 337/201
5,229,739 A * 7/1993 Oh ..... H01H 85/055 337/290
5,416,461 A * 5/1995 Totsuka ..... H01H 85/0417 337/261
5,739,741 A * 4/1998 Hanazaki ..... H01H 85/0417 337/160
5,854,583 A * 12/1998 Falchetti ..... H01H 85/044 337/290
6,275,135 B1 * 8/2001 Hibayashi ..... H01H 85/044 337/186
6,930,585 B2 * 8/2005 Kawazoe ..... H01H 85/0417 337/186
7,659,804 B2 * 2/2010 Harris ..... H01H 85/045 337/158
8,368,502 B2 * 2/2013 Washizaki ..... H01H 85/0418 29/623
8,400,252 B2 * 3/2013 Jung, II ..... H01H 85/0052 337/182
8,629,749 B2 * 1/2014 Chiu ..... H01H 85/165 337/159
9,196,445 B2 * 11/2015 Douglass ..... H01H 85/0013
9,472,364 B2 10/2016 Matthiesen et al.
9,824,842 B2 * 11/2017 Abad ..... H01H 85/165
10,141,150 B2 * 11/2018 Aberin ..... H01H 85/17
10,707,043 B2 7/2020 Yoneda
2004/0132921 A1 7/2004 Fujimoto et al.
2006/0173114 A1 8/2006 Fujimoto et al.
2009/0066470 A1 * 3/2009 Miyamoto ..... H01H 85/0417 337/163
2012/0286922 A1 * 11/2012 Matsumoto ..... H01H 85/0078 337/206
2014/0035717 A1 * 2/2014 Nomura ..... H01H 85/165 337/186
2015/0077212 A1 * 3/2015 Matsumoto ..... H01H 85/153 337/187
2015/0318131 A1 11/2015 Matthiesen et al.
2016/0013001 A1 1/2016 Yoneda et al.
2016/0172143 A1 * 6/2016 Yoneda ..... H01H 85/08 337/186
2017/0236673 A1 8/2017 Yoneda
2020/0090894 A1 * 3/2020 Gaitan ..... H02G 3/086

FOREIGN PATENT DOCUMENTS

JP 2013-251117 A 12/2013
JP 2014-209467 A 11/2014
JP 2016-062649 A 4/2016
JP 2016-071972 A 5/2016
KR 10-2017-0007320 A 1/2017
WO WO 02/085984 A1 10/2002
WO WO 2015/168561 A1 11/2015
WO WO 2016/047681 A1 3/2016

OTHER PUBLICATIONS

Nov. 19, 2020, Chinese Office Action issued for related CN Application No. 201880010918.0.
Jun. 18, 2021, Chinese Office Action issued for related CN application No. 201880010918.0.

* cited by examiner 50
4
3
22a
18
2

22
5a
11

5b
29
11a

17

28
22

FUSE DEVICE

CROSS REFERENCE TO PRIOR APPLICATION

This application is a National Stage Patent Application of PCT International Patent Application No. PCT/JP2018/004922 (filed on Feb. 13, 2018) under 35 U.S.C. § 371, which claims priority to Japanese Patent Application Nos. 2017-037574 (filed on Feb. 28, 2017), 2017-082025 (filed on Apr. 18, 2017), and 2018-018293 (filed on Feb. 5, 2018) which are all hereby incorporated by reference in their entirety.

TECHNICAL FIELD

The present technology relates to a fuse device mounted on a current path, which blows out a fuse element by self-heating when a rate-exceeding current flows to interrupt the current path, and specifically relates to a fuse device that can be used for high rating and high current applications.

BACKGROUND ART

Conventionally, fuse elements blown by self-heating when a rate-exceeding current flows are used to interrupt a current path. Examples of commonly used fuse elements include holder-fixed fuses having solder enclosed in glass tubes, chip fuses having an Ag electrode printed on a ceramic substrate surface, and screw-in or insertable fuses having a copper electrode with a narrow portion assembled into a plastic case.

However, problems have been identified in existing fuse elements described above such as inability to surface mount using reflow, low current ratings, and inferior blowout speeds when increasing size for higher current ratings.

Moreover, in the case of a reflow-mountable rapid-interruption fuse device, in general, this would preferably have a high melting point Pb solder with a melting point of 300° C. or more in the fuse element from the viewpoint of blowout properties. However, use of solder containing Pb is limited with few exceptions under the RoHS directive, and demand for Pb-free products is expected to increase in the future.

Thus, there is a need to develop a fuse element in which surface mounting using reflow is possible, fuse device mounting properties are excellent, ratings can be increased for application to large currents, and high-speed blowout property of rapidly interrupting a current path when a rate-exceeding current flows therethrough is achieved.

Therefore, a fuse device has been proposed in which, on an insulating substrate provided with a first and second electrodes, a fuse element is mounted between the first and second electrodes (see PLT 1).

By surface mounting the fuse device described in PLT 1 onto a circuit board, the fuse element is connected between the first and second electrodes to be incorporated in a part of the current path, and when a current higher than the rated current flows, the self-heating causes blowout of the fuse element to interrupt the current path.

CITATION LIST

Patent Literature

PLT 1: Japanese Unexamined Patent Application No. 2014-209467

SUMMARY OF INVENTION

Technical Problem

Here, the application of this type of fuse device is extended from electronic appliances to high current applications such as industrial machines, electric bicycles, electric bikes, and cars, among others. Therefore, with the increase in capacity and rating of electronic appliances and battery packs to be mounted, fuse devices are required to further improve the current rating.

In order to increase the current rating, it is effective to reduce the resistance by increasing the size of the fuse element. However, the fuse element melts while generating an arc discharge when a voltage exceeding the rating is applied and an overcurrent flows. Therefore, as the fuse element is increased in size, the impact caused by arc discharge increases in proportion to the increase in size.

Further, with the increase in the current rating, the temperature at the time of the self-heating interruption by the overcurrent also increases, and the thermal influence on the element housing also increases.

For this reason, the case member attached to the insulating substrate to protect the fuse element cannot withstand the thermal influence and the rapidly increasing internal pressure at the time of current interruption and thus might be broken or displaced or dropped from the insulating substrate. In addition, there is a risk that the dropped case may collide with the surrounding members, or the melt of the fuse element may scatter and adhered to the surrounding members, resulting in unexpected damage such as a short circuit.

As a measure to stop the arc discharge immediately and interrupt the circuit, there have also been proposed high voltage compatible current fuses such as fuses having arc extinguishing material packed into a hollow case and fuses in which fuse elements are helically wrapped around a heat dissipation material to generate a time lag. However, either of the conventional high voltage current fuses requires complicated materials and processes such as encapsulation of arc-extinguishing material and manufacturing of a helical fuse, which are disadvantageous in terms of miniaturization of fuse devices and high current rating.

In view of this, it is an object of the present invention to provide a fuse device used for high rating and high current applications excellent in impact resistance at the time of current interruption, and capable of preventing falling off of the case.

Solution to Problem

In order to solve the problems described above, the fuse device according to the present technology includes: a base member; a cover member fitted to the base member and covering a surface of the base member; and a fuse element disposed between the base member and the cover member; wherein one of the base member and the cover member is provided with a side wall intersecting with the plane of the surface of the base member and including an opening formed therein, and the other of the base member and the cover member is provided with a fitting projection projecting outward from a plane intersecting with the plane of the surface of the base member and fitted into the opening of the side wall.

Further, a fuse device to which the present technology is applied includes: a base member; a cover member fitted to the base member and covering a surface of the base member;

and a fuse element disposed between the base member and the cover member; wherein the base member and the cover member are made of a nylon type plastic material.

Advantageous Effects of Invention

According to the fuse device of the present technology, by fitting the fitting projection of the cover member to the opening of the base member, when the fuse element is interrupted by self-heating due to overcurrent while generating arc discharge, even if a pressure is suddenly applied to the cover member upwardly from the surface of the base member, the cover member can be prevented from being disengaged from the base member since the opening and the fitting projection abut on each other to improve resistance to the upward pressure from the surface of the base member.

DESCRIPTION OF EMBODIMENTS

Figure 1:
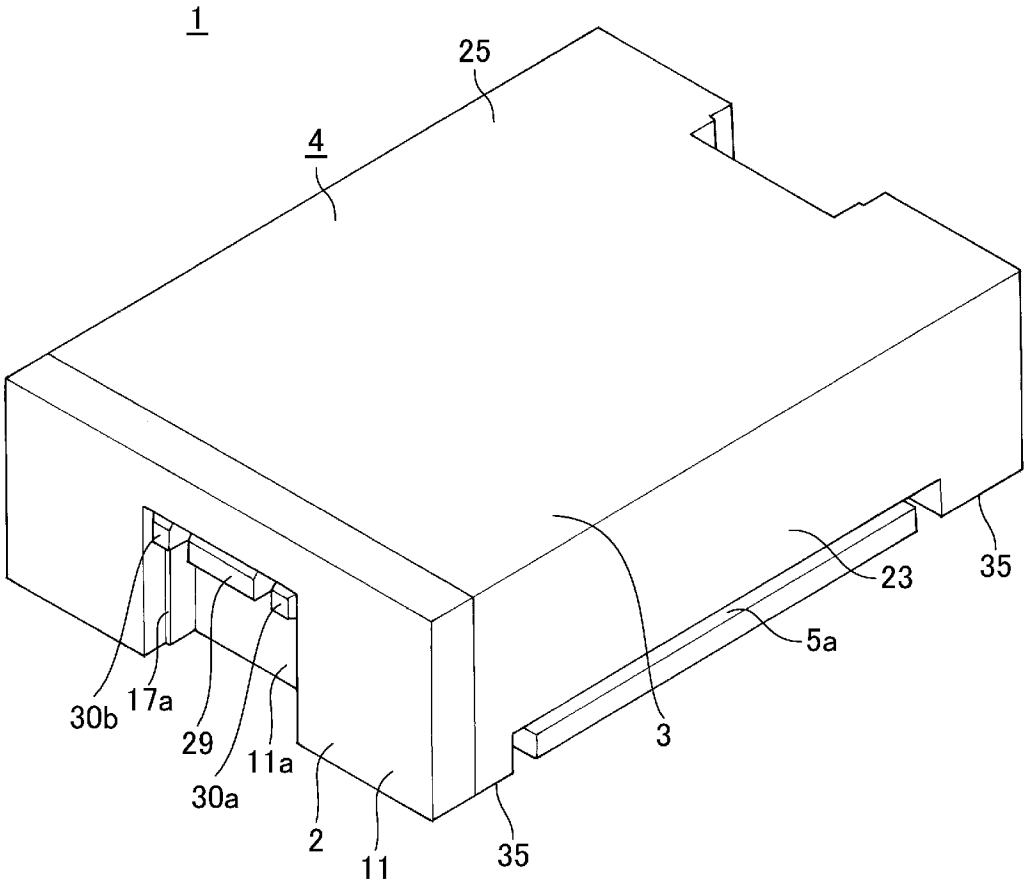
FIG. 1 is an external perspective view illustrating a fuse device viewed from the cover member side.

Hereinafter, a fuse device according to the present technology will be described in detail with reference to the accompanying drawings. It should be noted that the present disclosure is not limited to the following embodiments and various modifications can be made without departing from the scope of the present disclosure. Moreover, the features illustrated in the drawings are shown schematically and are not intended to be drawn to scale. Actual dimensions should be determined in consideration of the following description. Furthermore, those skilled in the art will appreciate that dimensional relations and proportions may be different among the drawings in certain parts.

Fuse Device

A fuse device 1 according to the present disclosure realizes a compact and highly rated fuse device, by having a small planar size of 3 to 5 mm×5 to 10 mm and a height of 2 to 5 mm, while having a resistance of 0.2 to 1 mΩ, and a high current rating of 50 to 150 A. It is a matter of course that the present disclosure can be applied to a fuse device having any size, resistance value, and current rating.

Figure 2:
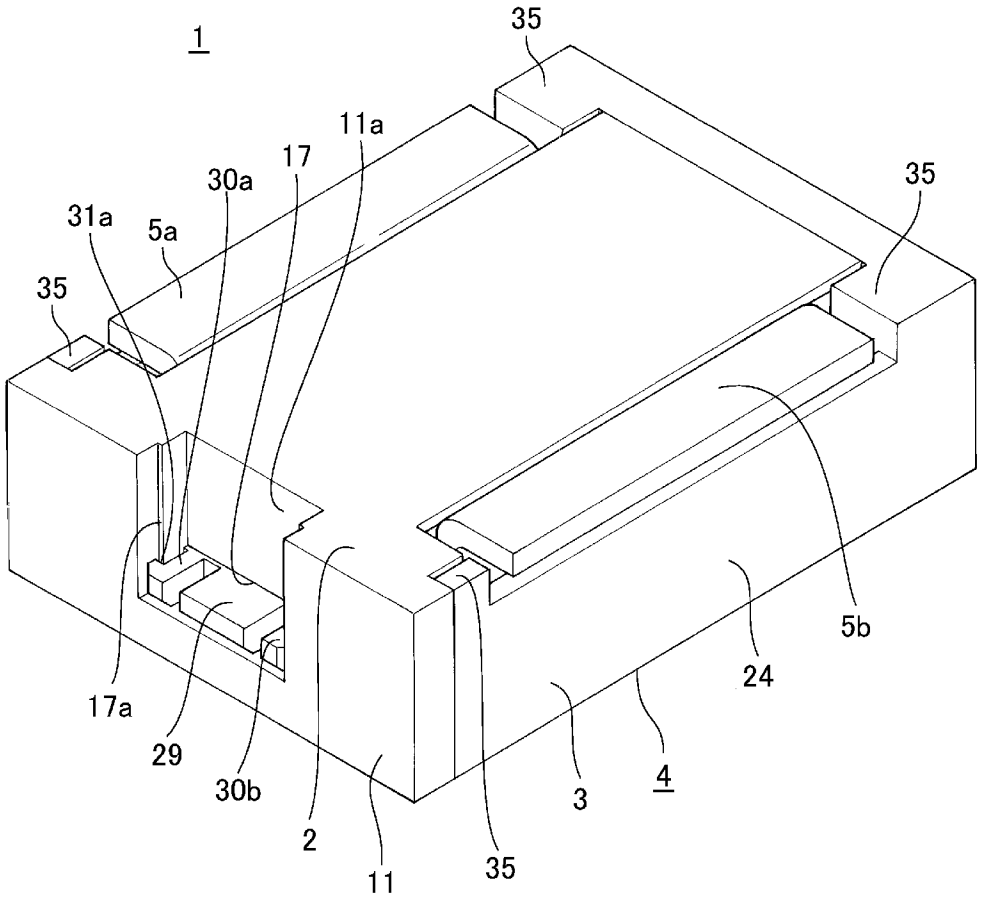
FIG. 2 is an external perspective view illustrating a fuse device viewed from the base member side.
Figure 3:
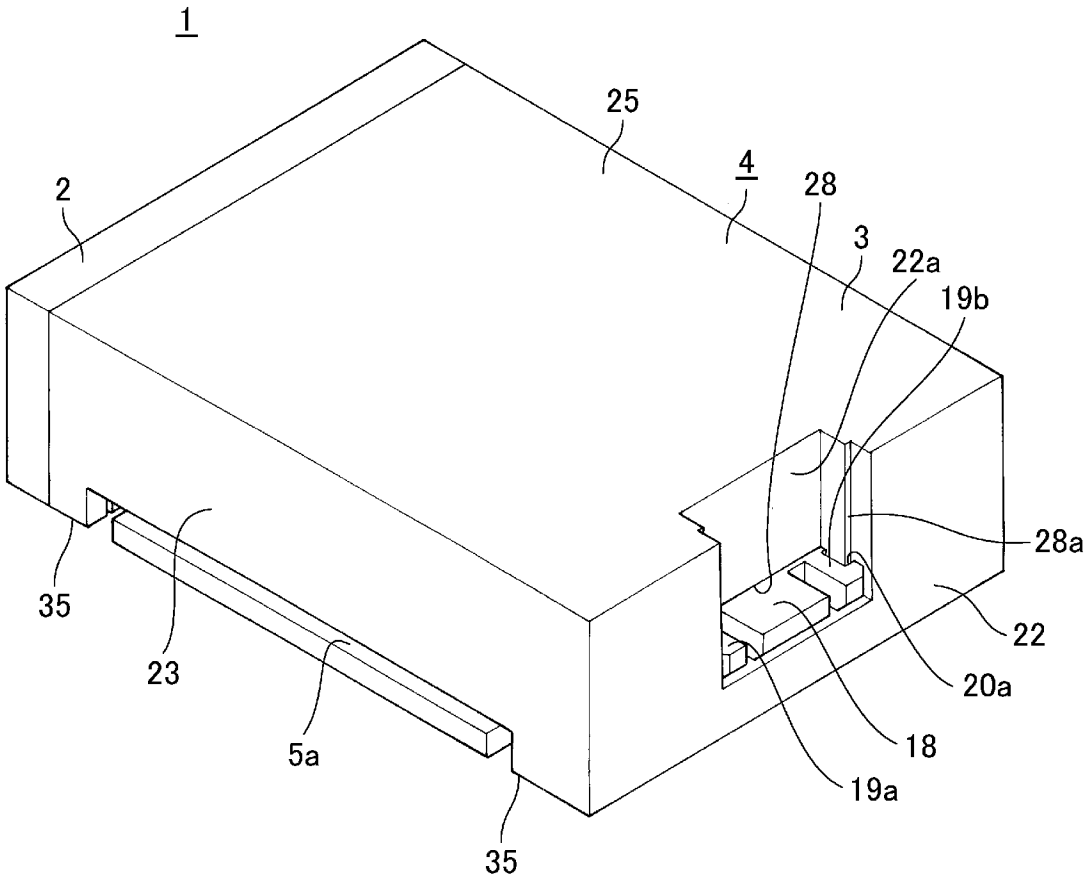
FIG. 3 is an external perspective view illustrating a fuse device viewed from the cover member side.

As shown in FIGS. 1 to 3, the fuse device 1 according to the present invention includes a base member 2 and a cover member 3 covering a surface 2*a* of the base member 2. The base member 2 and the cover member 3 are fitted to each other to form an element housing 4. It should be noted that FIG. 1 is an external perspective view illustrating the fuse device 1 viewed from the cover member 3 side, FIG. 2 is an external perspective view illustrating the fuse device 1 viewed from the back surface side of the base member 2, and FIG. 3 is an external perspective view illustrating the fuse device 1 viewed from the cover member 3 side.

Figure 4B:
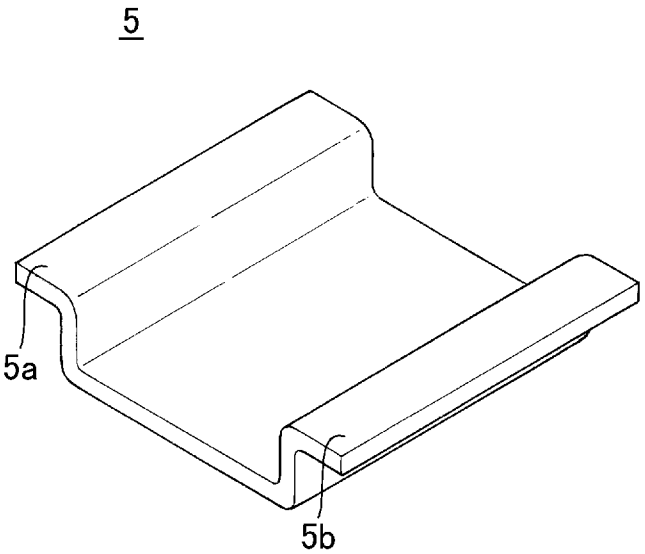
FIG. 4 (A) is an external perspective view illustrating a fuse element viewed from the front surface side, and FIG. 4 (B) is an external perspective view illustrating the fuse element viewed from the back surface side.
Figure 4A:
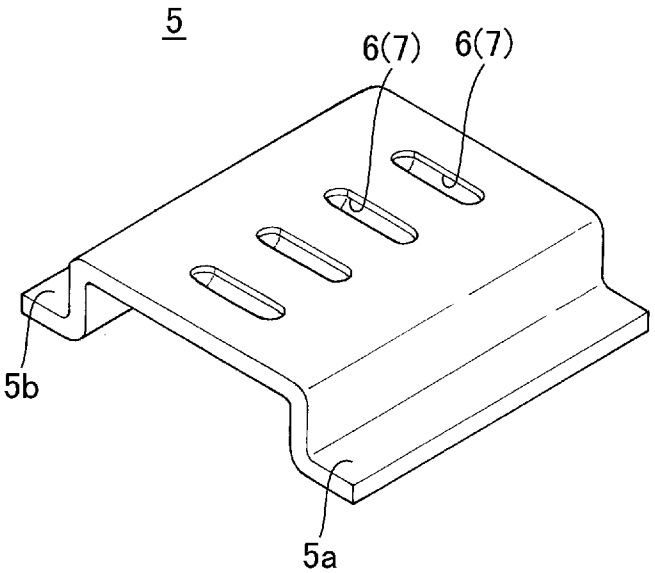
Figure 5:
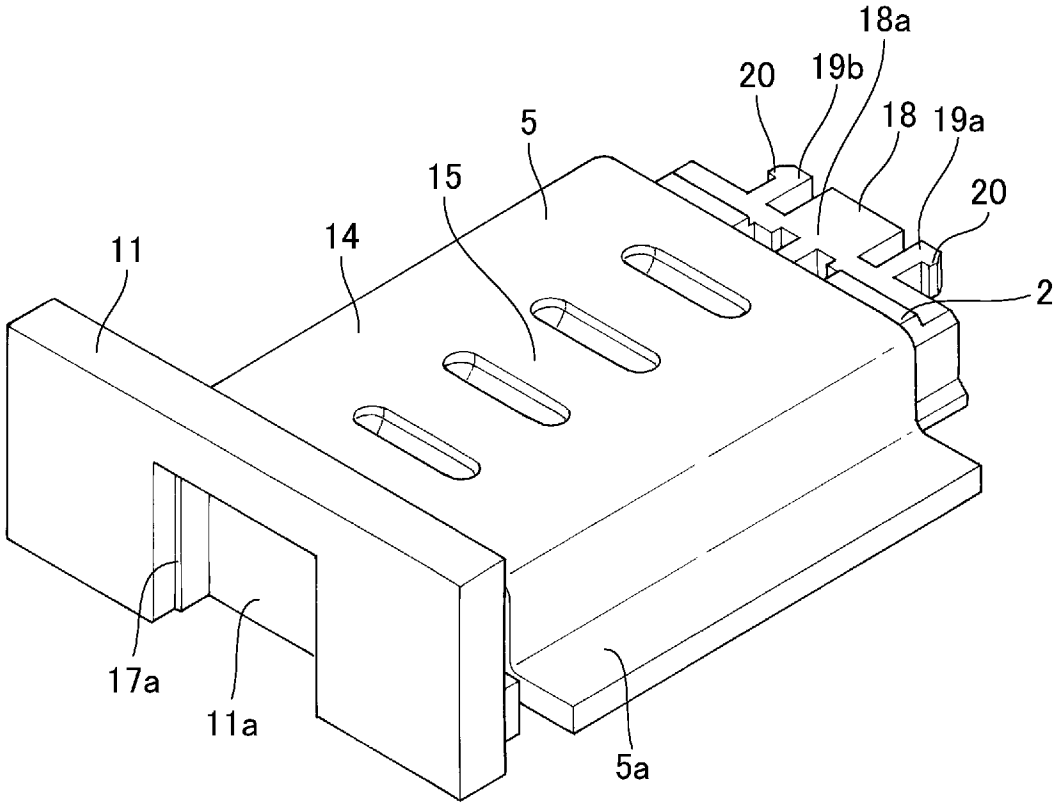
FIG. 5 is an external perspective view illustrating a state in which a fuse element is mounted on a base member.
Figure 6:
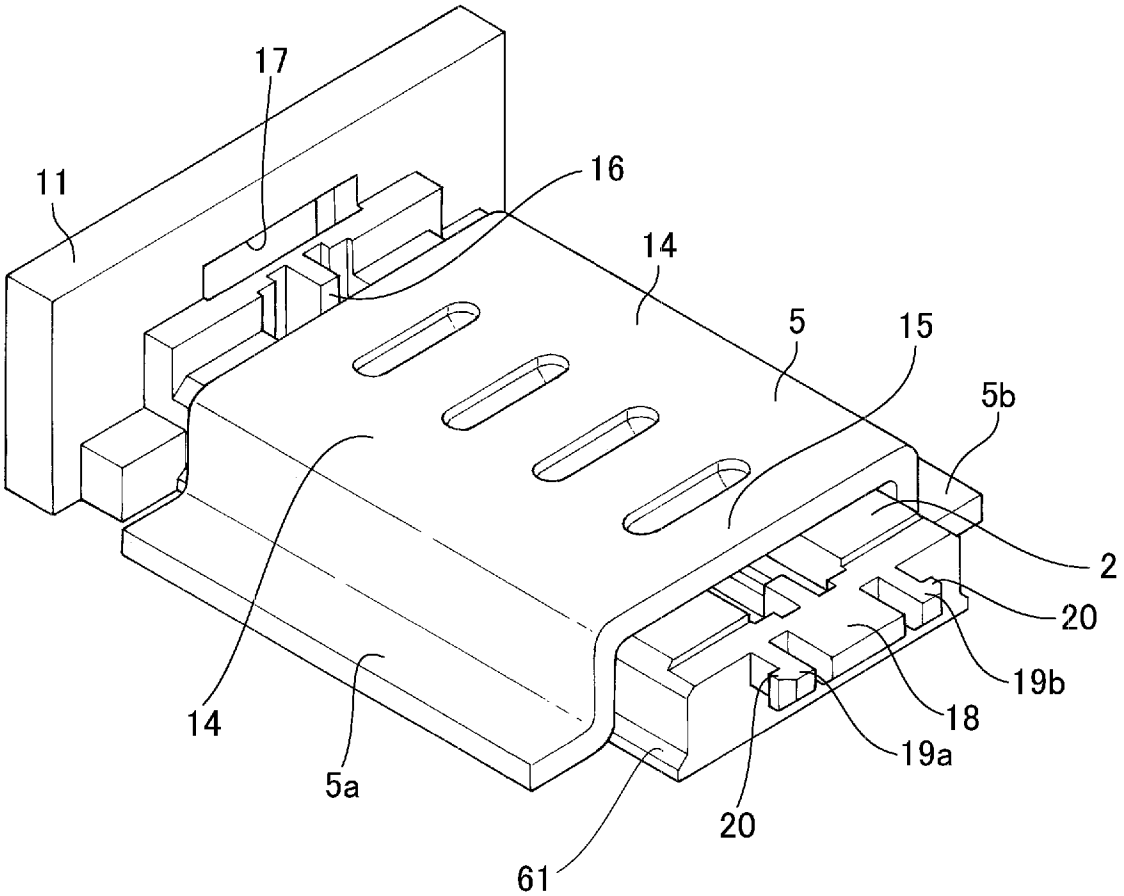
FIG. 6 is an external perspective view illustrating a state in which a fuse element is mounted on a base member.

A fuse element 5 is mounted on the base member 2. As shown in FIGS. 4 (A) and 4 (B), the fuse element 5 is formed into a substantially rectangular plate shape and both sides in the current flow direction thereof are bent along the side surface of the base member 2, and can be fitted on the surface 2*a* of the base member 2 as shown in FIGS. 5 and 6. Further, the fuse element 5 has terminal portions 5*a* and 5*b* both ends of which are extended outwardly and connected to connection electrodes of an external circuit (not shown). The fuse element 5 is sandwiched between a pair of lower and upper members, the base member 2 and the cover member 3, and the pair of terminal portions 5*a* and 5*b* are led out of the element housing 4. When the fuse device 1 is mounted on the external circuit board, the terminal portions 5*a* and 5*b* of the fuse element 5 are connected to the connection electrodes of the external circuit, and the fuse device 1 is incorporated in the current path of the external circuit. When a rate-exceeding current flows through the fuse device 1, the fuse element 5 is blown by self-heating to interrupt the current path of the external circuit. The specific configuration of the fuse element 5 will be described in detail later.

Base Member

Figure 7:
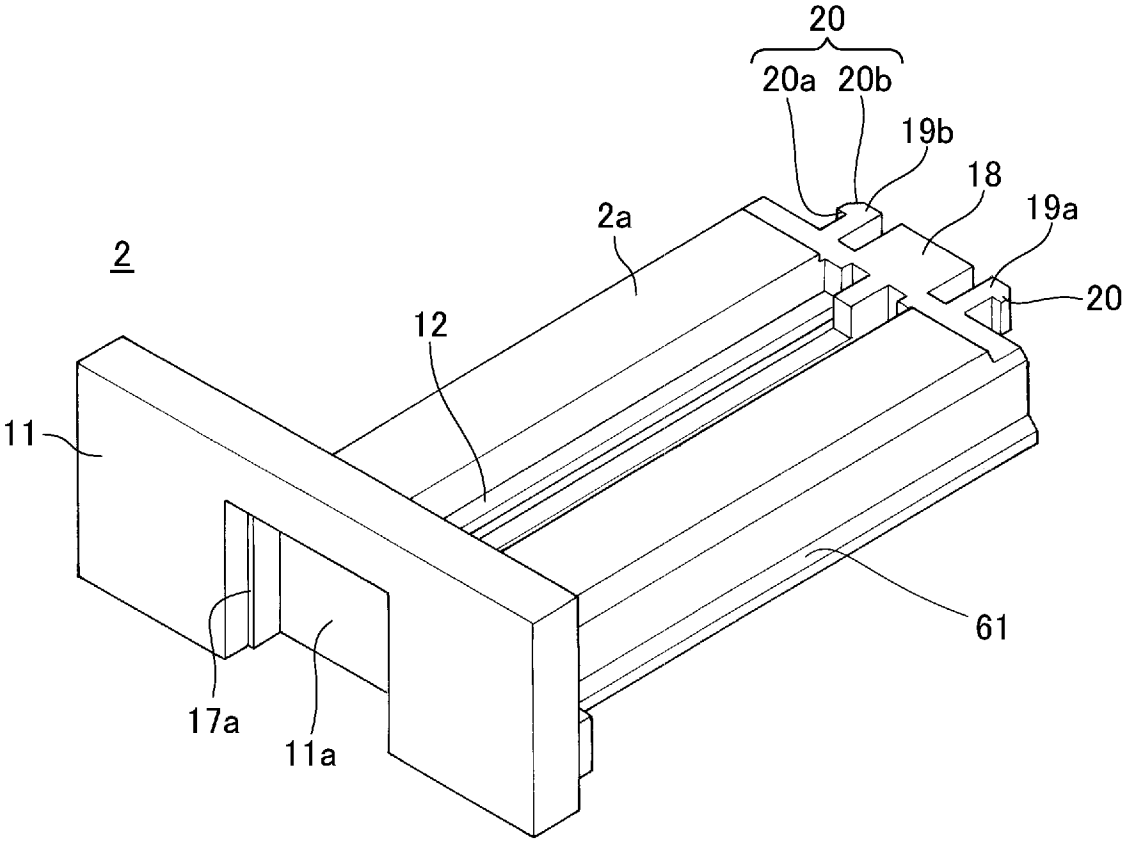
FIG. 7 is an external perspective view illustrating the base member viewed from the first side wall side.
Figure 8:
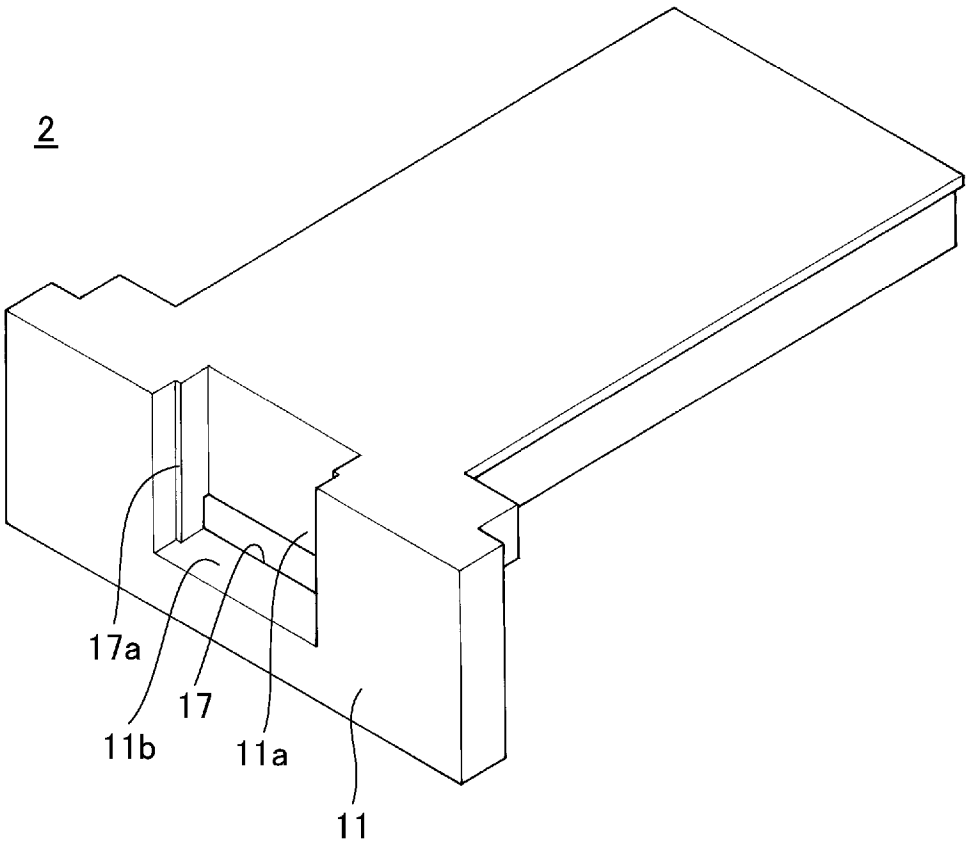
FIG. 8 is an external perspective view illustrating the base member viewed from the back surface side.
Figure 9:
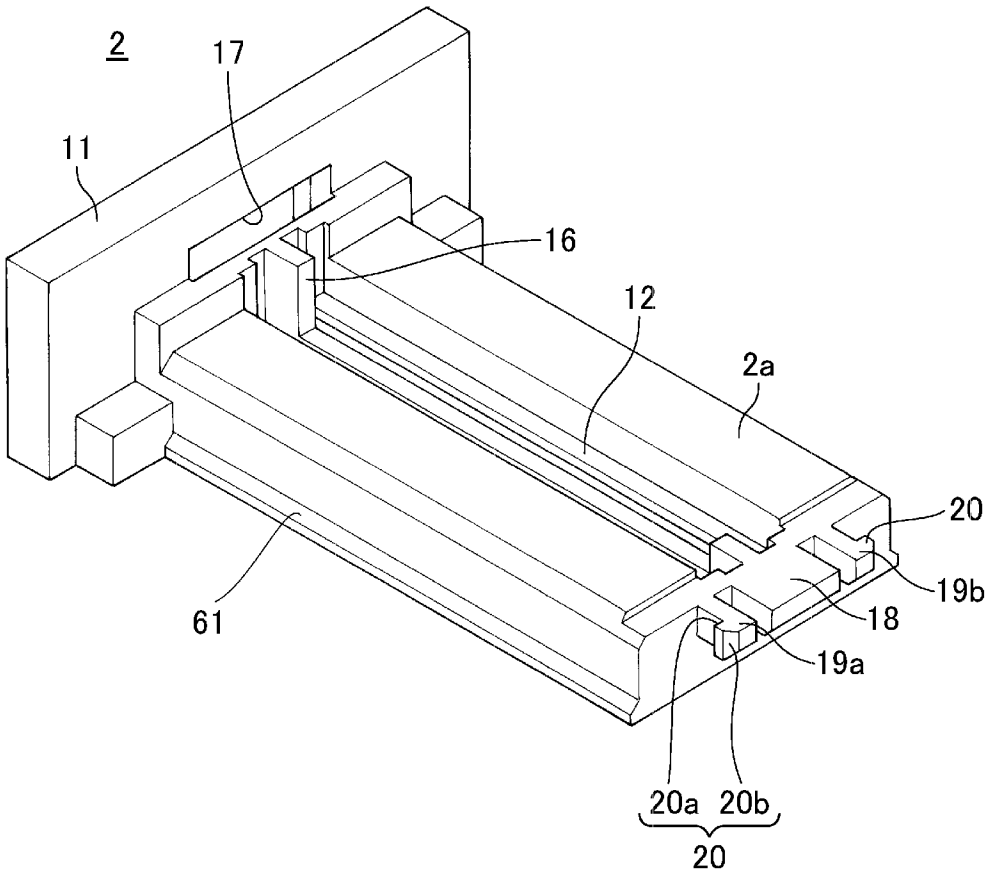
FIG. 9 is an external perspective view illustrating the base member viewed from the first fitting projection side.

The base member 2 is formed of an insulating member such as engineering plastic, alumina, glass ceramics, mullite, or zirconia, among others. Further, the base member is produced by a manufacturing method corresponding to the material, such as molding and powder molding, among others. As shown in FIGS. 7 to 9, the base member 2 has the surface 2*a* on which the fuse element 5 is mounted, and provided on one side edge side with a first side wall 11 intersecting with the plane of the surface 2*a* and constituting a side surface of the element housing 4. It should be noted that FIG. 7 is an external perspective view illustrating the base member 2 viewed from the side of the first side wall 11, FIG. 8 is an external perspective view illustrating the base member 2 viewed from the back side, and FIG. 9 is an external perspective view illustrating the base member 2 viewed from the first fitting projection 18 side.

The base member 2 is formed in a substantially rectangular plate shape, and the fuse element 5 is mounted with the width direction as the current flow direction. Moreover, the base member 2 is also provided with a groove 12 formed over the length direction in the approximate center of the width direction. The base member 2 and the cover member 3 sandwich and hold the fuse element 5 on both sides of the groove 12. As a result, the fuse element 5 faces the groove 12 in the width direction perpendicular to the current flow direction, and a high thermal conductivity portion 14 sandwiched by the base member 2 and the cover member 3 and a low thermal conductivity portion 15 facing the groove 12 are formed.

The high thermal conductivity portion 14 has relatively high heat dissipation in the plane of the fuse element 5 by being held between the base member 2 and the cover member 3 and can dissipate heat generated by an overcurrent to the outside through the base member 2 and the cover member 3, thereby suppressing temperature increase and suppressing overheating of the terminal portions 5*a* and 5*b*. The low thermal conductivity portion 15 does not make thermal contact with the base member 2 and the cover member 3 by facing the groove 12, and has relatively low heat dissipation in the plane of fuse element 5 by contacting with air having a thermal conductivity lower than that of the base member 2 and the cover member 3, thereby acting as a blowout portion blown by concentration of heat generated by overcurrent. It should be noted that it is enough for the high thermal conductivity portion 14 to be in thermal contact with the base member 2 and the cover member 3, and this portion may be in direct contact with the base member 2 and the cover member 3, or may be in contact with the base member 2 and the cover member 3 via a member having an appropriate thermal conductivity.

A positioning wall 16 for positioning the fuse element 5 is formed at an end of the groove 12 on the first side wall 11 side. The positioning wall 16 is erected on the surface 2*a* of the base member 2 from the groove 12 and determines the mounting position on the base member 2 by abutting on one side of the fuse element 5.

Adhesive

Further, in the fuse device 1, the fuse element 5 may be connected to the base member 2 or to the base member 2 and the cover member 3 with an adhesive (not shown). The adhesive is provided at a portion of the surface 2*a* of the base member 2 other than the groove 12. This configuration of the fuse device 1 enhances the adhesion of the high thermal conductivity portion 14 of the fuse element 5 with the base member 2 or with the base member 2 and the cover member 3, thereby conducting heat more efficiently.

Any of known adhesives can be used for the adhesive, but it is preferable for the adhesive to have a high thermal conductivity in order to promote heat dissipation of the fuse element 5 (for example, KJR-9086 manufactured by Shin-Etsu Chemical Co., Ltd., SX 720 manufactured by CEMEDINE Co., Ltd., and SX1010 manufactured by CEMEDINE Co., Ltd.) As the adhesive, a conductive adhesive containing conductive particles in a binder resin may be used. By using a conductive adhesive as the adhesive, in addition to enhancing the adhesion of the fuse element 5 with the base member 2 or with the base member 2 and the cover member 3, it is possible to efficiently transfer the heat of the high thermal conductivity portion 14 to the base member 2, or the base member 2 and the cover member 3 via the conductive particles. Alternatively, solder may be used instead of the adhesive.

On one side edge side of the base member 2, a first side wall 11, which constitutes a side surface of the element housing 4, is formed so as to stand in a direction intersecting, preferably substantially perpendicular to, the plane of the surface 2*a* of the base member 2. The first side wall 11 is provided with a fitting recess 11*a* and there are formed, in the fitting recess 11*a*, a first opening 17 that receives a second fitting projection 29 formed on the cover member 3 as described later and an abutment surface 11*b* that is continuous with the first opening 17 and abuts on the second fitting projection 29 inserted into the first opening 17.

In addition, on the other side edge of the base member 2 opposite to the one side edge on which the first side wall 11 is provided, there are formed a first fitting projection 18 that protrudes outward from a plane intersecting with the plane of the surface 2*a* of the base member 2 and fits in a second opening 28 formed in a second side wall 22 formed in the cover member 3 as described later and first and second locking pieces 19*a*, 19*b* that protrude outward from the plane intersecting with the plane of the surface of the surface 2*a* of the base member 2 on both sides of the first fitting projection 18 and is locked to the second opening 28. The first fitting projection 18 preferably protrudes outward along a plane parallel with the surface 2*a* of the base member 2.

Cover Member

Figure 10:
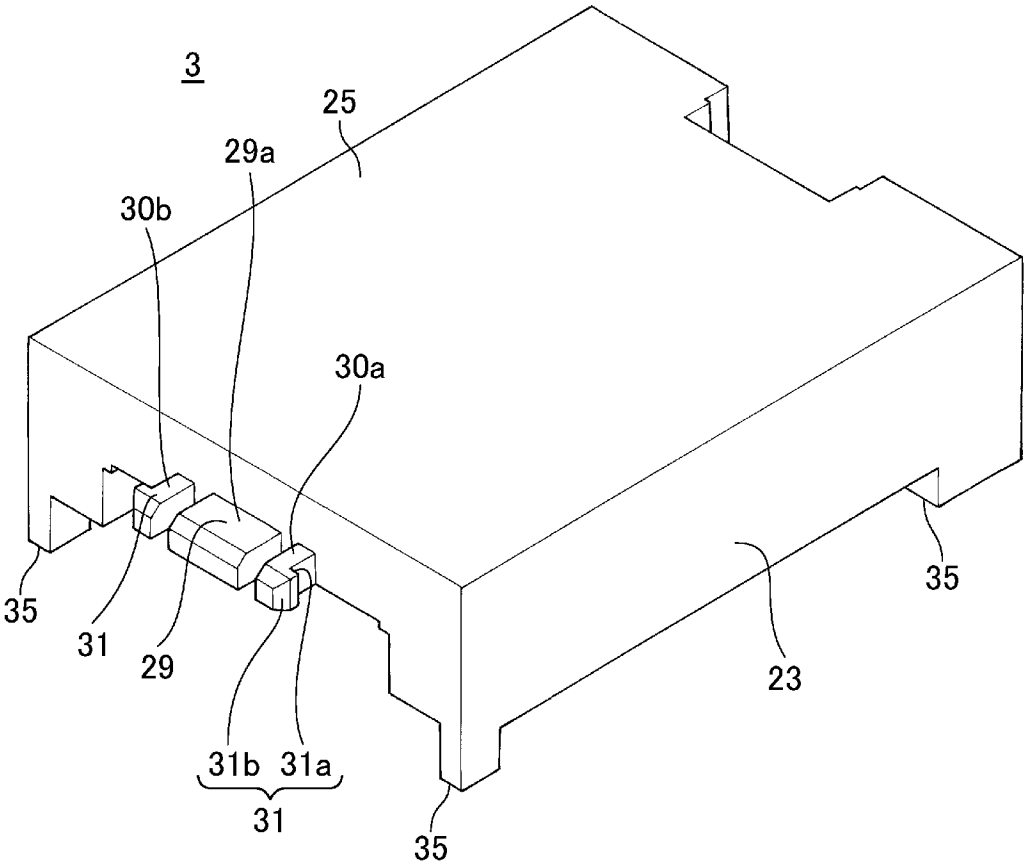
FIG. 10 is an external perspective view illustrating the cover member viewed from the top surface side.
Figure 11:
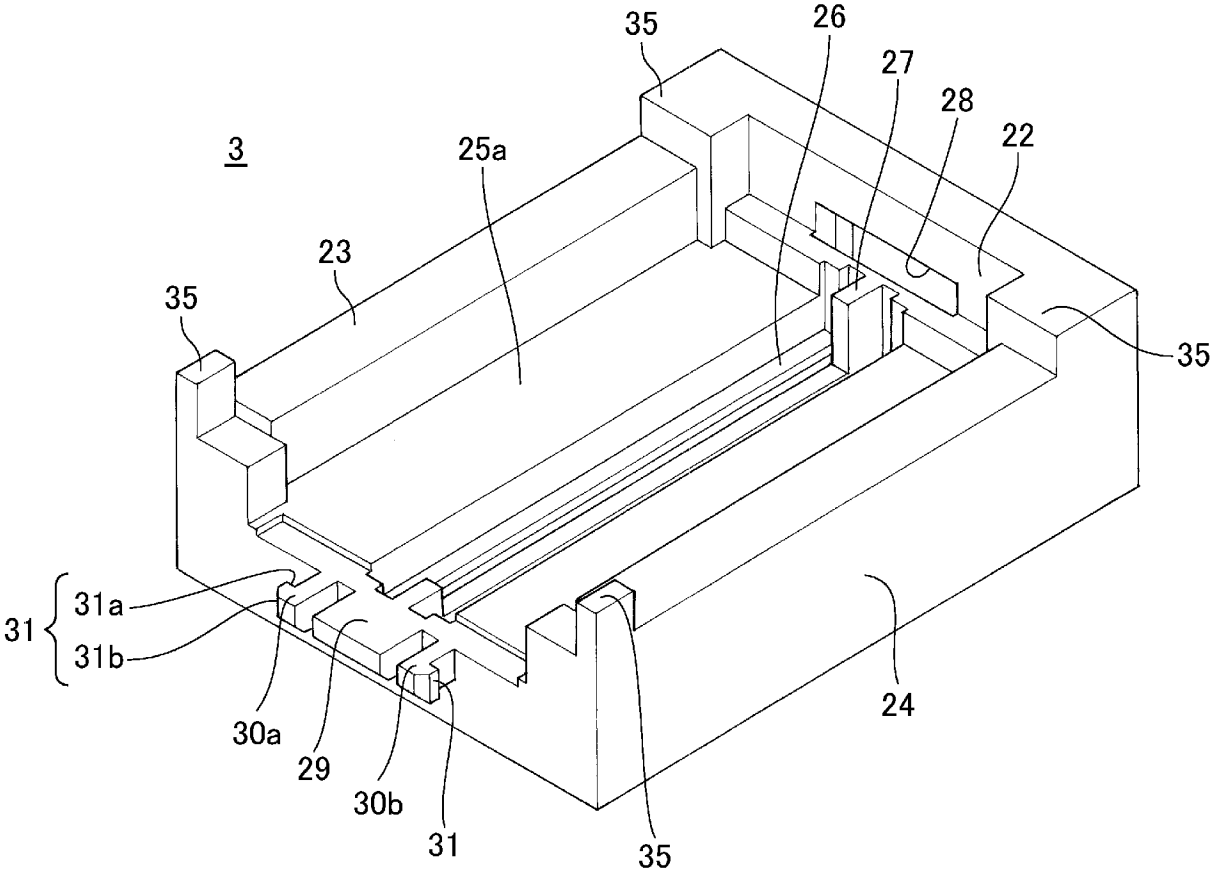
FIG. 11 is an external perspective view illustrating the inside of a cover member.
Figure 12:
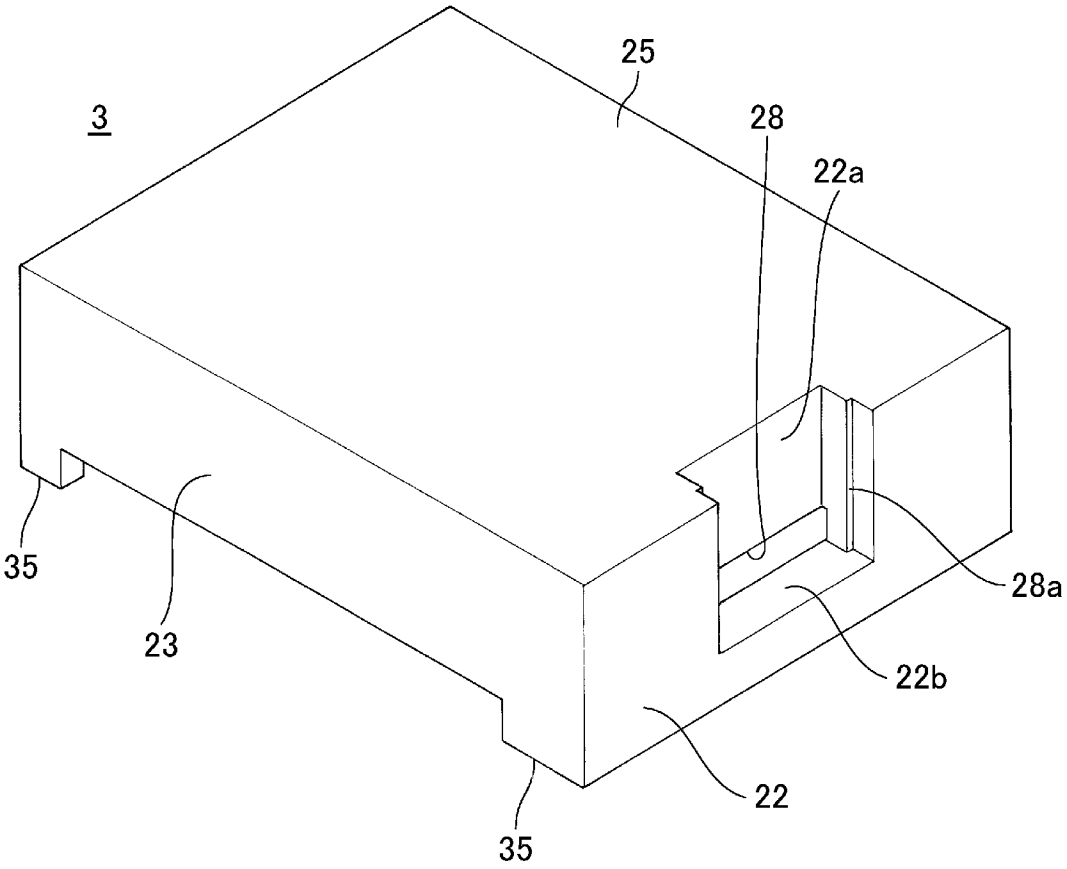
FIG. 12 is an external perspective view illustrating the cover member viewed from the second side wall side.

The cover member 3 for covering the surface 2*a* of the base member 2 can be formed of the same material and the same manufacturing method as the base member 2. As shown in FIGS. 10 to 12, the cover member 3 includes a second side wall 22 constituting a side surface facing the first side wall 11 of the element housing 4; third and fourth side walls 23, 24 provided in the direction of current flow of the fuse element 5 and with the terminal portions 5*a*, 5*b* exposed to the outside; and a top surface 25 constituting the top surface of the element housing 4. It should be noted that FIG. 10 is an external perspective view illustrating the cover member 3 viewed from the top surface 25 side, FIG. 11 is an external perspective view illustrating the inside of the cover member 3, and FIG. 12 is an external perspective view illustrating the cover member 3 viewed from the second side wall 22 side.

As with the base member 2, the inner surface 25*a* of the top surface 25 of the cover member 3 has a groove 26 formed substantially in the center in the width direction and extending in the length direction. The cover member 3 and the base member 2 sandwiches the high thermal conductivity portion 14 of the fuse element 5 on both sides of the groove 26.

Further, at an end of the groove 26 on the second side wall 22 side, a positioning wall 27 for positioning the fuse element 5 together with the positioning wall 16 is formed. The positioning wall 27 is erected on the inner surface 25*a* of the top surface 25 of the cover member 3 from the groove 26, and determines the mounting position on the base member 2 by abutting on the other side surface of the fuse element 5.

On one side edge side of the cover member 3, a second side wall 22 is erected in a direction intersecting, preferably substantially perpendicular to the plane of the surface 2*a* of the base member 2 to constitute a side surface of the element housing 4. The second side wall 22 is provided with a fitting recess 22*a*, and in this fitting recess 22*a*, there are formed a second opening 28 that receives a first fitting projection 18 formed on the base member 2 as described above and an abutment surface 22*b* that is continuous with the second opening 28 and abuts on the first fitting projection 18 inserted into the second opening 28.

In addition, on the other side edge of the cover member 3 opposite to the one side edge on which the second side wall 22 is provided, there are formed a second fitting projection 29 that protrudes outward from a plane intersecting with the plane of the surface 2*a* of the base member 2 and fits in the first opening 17 formed in the first side wall 11 formed in the base member 2 as described above and third and fourth locking pieces 30*a*, 30*b* that protrude outward from a plane intersecting with the plane of the surface 2*a* of the base member 2 on both sides of the second fitting projection 29 and is locked to the first opening 17. The second fitting projection 29 preferably protrudes outward along a plane parallel with the surface 2*a* of the base member 2.

Opnening/Fitting Projection/Locking Piece

In fuse device 1, after the fuse element 5 is mounted on the surface 2*a* of base member 2, the cover member 3 is assembled to the base member 2 to form an element housing 4. In the fuse device 1, the second fitting projection 29 formed on the cover member 3 is fitted into the first opening 17 formed in the first side wall 11 of the base member 2, and the first fitting projection 18 formed on the base member 2 is fitted into the second opening 28 formed in the second side wall 22 of the cover member 3.

In the fuse device 1, when the second fitting projection 29 of the cover member 3 is fitted into the first opening 17 of the base member 2, an abutment surface 11*b* of the fitting recess 11*a* abuts on the upper surface of the second fitting projection 29 (FIG. 1). As a result, even when an pressure is suddenly applied to the cover member 3 upwardly from the surface 2*a* of the base member 2 when the fuse element 5 is interrupted by self-heating due to overcurrent while generating arc discharge, by fixing the second fitting projection 29 with the abutment surface 11*b* continuous with the first opening 17, the resistance to the upward pressure from the surface 2*a* of the base member 2 is improved, thereby preventing the cover member 3 from being disengaged from the base member 2.

Similarly, in the fuse device 1, when the first fitting projection 18 of the base member 2 is fitted into the second opening 28 of the cover member 3, an abutment surface 22*b* of the fitting recess 22*a* abuts on the lower surface of the first fitting projection 18 (FIG. 3). As a result, by fixing the first fitting projection 18 with the abutment surface 22*b* continuous with the second opening 28, the resistance to the upward pressure from the surface 2*a* of the base member 2 is improved, thereby preventing the cover member 3 from being disengaged from the base member 2.

Therefore, in the fuse device 1, resistance to the upward pressure from the surface 2*a* of the base member 2 can be improved at least by forming an opening in one of the base member 2 and the cover member 3 and forming a fitting projection on the other one; preferably, however, by forming openings and fitting projections in each of the base member 2 and the cover member 3 to achieve mutual fitting, the cover member 3 can be more reliably prevented from disengaged from the base member 2.

Here, the first opening 17 has a rectangular shape having a length direction corresponding to the width direction of the base member 2, and the first side wall 11 is also formed thick such that the abutment surface 11*b* which presses the second fitting projection 29 also has a width corresponding to the thickness of the first side wall 11. Similarly, the second opening 28 has a rectangular shape having a length direction corresponding to the width direction of the base member 2, and the second side wall 22 is also formed thick such that the abutment surface 22*b* which is pressed by the first fitting projection 18 also has a width corresponding to the thickness of the second side wall 22.

As shown in FIG. 10, the second fitting projection 29 to be fitted into the first opening 17 protrudes in a direction parallel with the plane of the surface 2*a* of the base member 2 and is fitted by being inserted into the first opening 17 of the first side wall 11. The second fitting projection 29 is fitted into the first opening 17 from the distal end thereof to the base portion 29*a* and abuts on the abutment surface 11*b*. Similarly, as shown in FIG. 7, the first fitting projection 18 to be fitted into the second opening 28 protrudes in a direction parallel with the plane of the surface 2*a* of the base member 2 and is fitted by being inserted into the second opening 28 of the second side wall 22. The first fitting projection 18 is fitted into the second opening 28 from the distal end thereof to the base portion 18*a* and abuts on the abutment surface 22*b*.

In the plane of the surface 2*a* of the base member 2, the length of the second fitting projection 29 in the width direction intersecting with the inserting direction into the first opening 17 is formed wider than the length in the inserting direction, and the abutment surface between the second fitting projection 29 and the abutment surface 11*b* is also wider in the width direction than in the inserting direction of the first opening 17. Similarly, in the plane of the surface 2*a* of the base member 2, the length of the first fitting projection 18 in the width direction intersecting with the inserting direction into the second opening 28 is formed wider than the length in the inserting direction, and the abutment surface between the first fitting projection 18 and the abutment surface 22*b* is also wider in the with direction than in the inserting direction of the second opening 28. As such, the first and second openings 17 and 28 have a structure with high impact resistance against the upward pressure from the surface 2*a* of the base member 2 by widely fitting the first and second fitting projections 18 and 29 in the width direction.

Further, the the first and second fitting projections 18 and 29 are not fitted by press-fitting into the first and second openings 17 and 28, do not have to have flexibility, can be increased in fitting strength by using a stronger material or by making the dimensions thicker, and can deeply inserted and fitted into the first and second openings 17 and 28.

Therefore, in the fuse device 1, when the fuse element 5 is interrupted by self-heating while generating arc discharge, the first and second fitting projections 18 and 29 are not softened by the high heat to be disengaged from the first and second openings 17 and 28, and even if the cover member 3 is rapidly pressurized upwardly from the surface 2*a* of the base member 2, the fittings between the first opening 17 and the second fitting projection 29, and between the second opening 28 and the first fitting projection 18 are not disengaged.

It should be noted that the distal ends of the first and second fitting projections 18 and 29, which serve as the insertion ends into the first and second openings 17 and 28, are chamfered to form a taper portions.

Here, the first opening 17 is provided on an extension line of the groove 12 of the base member 2 and has a rectangular shape having a length direction corresponding to the width direction of the base member 2. Similarly, the second opening 28 is provided on an extension line of the groove 12 of the base member 2 and has a rectangular shape having a length direction corresponding to the width direction of the base member 2. That is, the first and second openings 17 and 28 are positioned on an extension line of the low thermal conductivity portion 15 serving as a blown portion of the fuse element 5. Therefore, in the fuse device 1, the first and second fitting projections 18 and 29 are fitted to the first and second openings 17 and 28, respectively, correspondingly to the blowout portion, which is liable to be subjected to an impact due to arc discharge occurring at the time of the self-heating interruption of the fuse element 5. Therefore, it is possible to improve the resistance to the thermal effect and the rapidly increasing internal pressure more effectively.

The base member 2 is provided, on both sides of the first opening 17 of the first side wall, with locking step portions 17*a* for locking the third and fourth locking pieces 30*a*, 30*b* projecting from both sides of the second fitting projection 29 of the cover member 3. The locking step portion 17*a* prevents the cover member 3 from slipping out in a direction parallel with the plane of the surface 2*a* of the base member 2, and is formed on the side surface of the fitting recess 11*a* formed on the outer surface of the first side wall 11 and projects in a direction parallel with the plane of the first side wall 11 to form a stepped shape.

The third and fourth locking pieces 30*a* and 30*b* protrude in a direction parallel with the plane of the surface 2*a* of the base member 2, and locking claws 31 to be locked to the locking step portions 17*a* are formed at the distal ends thereof. The locking claw 31 bulges in a direction parallel with the surface 2*a* of the base member 2 and in a direction perpendicular to the direction in which the second fitting projection 29 is inserted into the first opening 17. The locking claw 31 has an locking surface 31*a* to be locked to the locking step portion 17*a*, and an arcuate or tapered sliding surface 31*b* for sliding on both sides of the first opening 17.

When the third and fourth locking pieces 30*a* and 30*b* are inserted into the first opening 17, the sliding surface 31*b* slides on both sides of the first opening 17 and is press fitted while being bent inward, and the locking claw 31 passes through the first opening 17, whereby the locking surface 31*a* is locked to the locking step portion 17*a*. Thus, the cover member 3 is prevented from slipping out in the inserting direction of the base member 2.

Thus, in the element housing 4 of the fuse device 1, the second fitting projection 29 formed on the cover member 3 is inserted into the first opening 17 formed on the first side wall 11 of the base member 2, whereby the resistance to the pressure generated above the surface 2*a* of the base member 2 is improved, and the third and fourth locking pieces 30*a*, 30*b* formed on the cover member 3 are inserted into the first opening 17 formed on the first side wall 11 of the base member 2 and the locking claw 31 is locked to the locking step portion 17*a*, thereby preventing slipping out in the inserting direction which is a direction parallel with the plane of the surface 2*a* of the base member 2.

Similarly, in the cover member 3, on both sides of the second opening 28 of the second side wall, locking step portions 28*a* for locking the first and second locking pieces 19*a*, 19*b* projecting from both sides of the first fitting projection 18 are formed. The locking step portion 28*a* is formed on the side surface of the fitting recess 22*a* formed on the outer surface of the second side wall 22 and projects in a direction parallel with the plane of the second side wall 22 to form a stepped shape. The first and second locking pieces 19*a* and 19*b* protrude in a direction parallel with the plane of the surface 2*a* of the base member 2, and locking claws 20 to be locked to the locking step portion 28*a* are formed at the distal ends thereof. The locking claw 20 bulges in a direction parallel with the surface 2*a* of the base member 2 and in a direction perpendicular to the direction in which the first fitting projection 18 is inserted into the second opening 28. The locking claw 20 has an locking surface 20*a* to be locked to the locking step portion 28*a*, and an arcuate or tapered sliding surface 20*b* for sliding on both sides of the second opening 28. Since the structures and functions of the locking step portion 28*a* and the first and second locking pieces 19*a* and 19*b* are the same as those of the locking step portion 17*a* and the third and fourth locking pieces 30*a* and 30*b*, the details thereof are omitted.

The fuse device 1 can prevent the cover member 3 from slipping out from the base member 2 in the direction of the inserting direction parallel with the plane of the surface 2*a* of the base member 2 by providing at least one of the base member 2 and the cover member 3 with an opening, forming a locking piece on the other one, and locking the base member 2 and the cover member 3 each other; preferably, however, by forming openings and locking pieces in each of the base member 2 and the cover member 3 to achieve mutual locking, the cover member 3 can be prevented from slipping out from the base member 2 in the inserting direction more reliably.

It should be noted that, in the fuse device 1, the resistance to the upward pressure from the surface 2*a* of the base member 2 is improved by the first and second locking pieces 19*a*, 19*b* abutting on the upper surface of the second opening 28, and similarly, the resistance to the upward pressure from the surface 2*a* of the base member 2 is improved by the third and fourth locking pieces 30*a*, 30*b* abutting on the upper surface of the first opening 17.

Fuse Element

Figure 13:
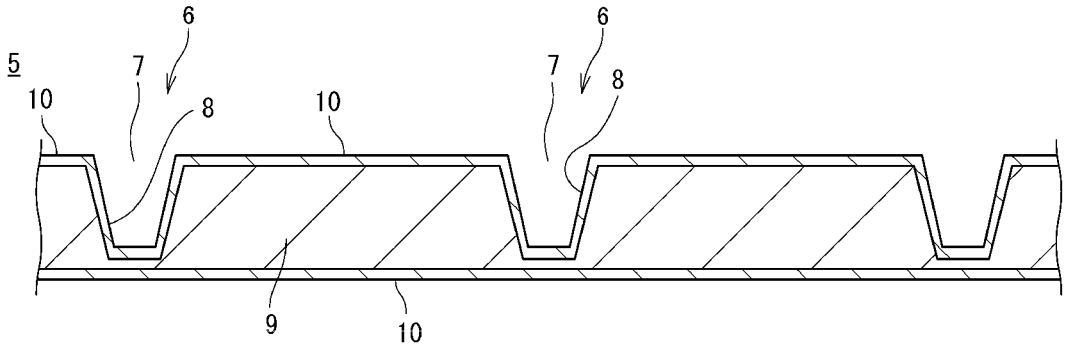
FIG. 13 is a cross-sectional view of a fuse element in which a deformation restricting portion is formed.

Next, the fuse element 5 will be described. The fuse element 5 is made of a low melting point metal such as solder or a Pb-free solder mainly composed of Sn, or a laminate of a low melting point metal and a high melting point metal. For example, as shown in FIG. 13, the fuse element 5 may have a laminated structure composed of an inner layer and an outer layer, and has a low melting point metal layer 9 as an inner layer and a high melting point metal layer 10 as an outer layer laminated on the low melting point metal layer 9.

The low melting point metal layer 9 is preferably a metal mainly composed of Sn, and is a material generally called "Pb free solder". The melting point of the low melting point metal layer 9 is not necessarily higher than the reflow temperature, and may melt at about 200° C. The high melting point metal layer 10 is a metal layer laminated on the surface of the low melting point metal layer 9, and is composed of, for example, Ag, Cu or a metal mainly composed of any one of these, and has a high melting point that does not melt even when the fuse device 1 is mounted on an external circuit board by a reflow furnace.

The fuse element 5 is not blown out even when the reflow temperature exceeds the melting temperature of the low melting point metal layer 9 by laminating the high melting point metal layer 10 as the outer layer on the low melting point metal layer 9 as the inner layer. Therefore, the fuse device 1 can be efficiently mounted by reflow.

Further, the fuse element 5 is not blown by self-heating while a predetermined rated current is flowing. When a current having a value higher than the rating flows, melting starts from the melting point of the low melting point metal layer 9 by self-heating, and the current path between the terminal portions 5*a* and 5*b* can be promptly interrupted. For example, when the low melting point metal layer 9 is made of a Sn—Bi based alloy or an In—Sn based alloy, the fuse element 5 starts melting at a low temperature of about 140° C. or 120° C. In these cases, for example, in the fuse element 5, for example, by using an alloy containing 40% or more of Sn as the low melting point metal, the melted low melting point metal layer 9 erodes the high melting point metal layer 10, whereby the high melting point metal layer 10 melts at a temperature lower than the melting temperature thereof. Therefore, the fuse element 5 can be blown out in a short time by utilizing the erosion of the high melting point metal layer 10 caused by the low melting point metal layer 9.

Further, since the fuse element 5 is configured by laminating the high melting point metal layer 10 on the low melting point metal layer 9 serving as an inner layer, the fusing temperature can be greatly reduced as compared with a conventional chip fuse made of a high melting point metal. Therefore, the fuse element 5 is formed wider in width and shorter in the current flow direction than the high melting point metal element, so that the fuse element 5 can be miniaturized while significantly improving the current rating and suppressing the influence of heat on the connection portion with the circuit board. In addition, the size and thickness of the fuse can be reduced as compared with the conventional chip fuse having the same current rating, and the fuse is excellent in rapid blowout property.

Further, the fuse element 5 can improve surge tolerance (pulse tolerance) in the case that an abnormally high voltage is instantaneously applied to the electric system in which the fuse device 1 is incorporated. That is, the fuse element 5 must not be blown out even in the case of a current of 100 A flows for several milliseconds. Because a large current flowing for an extremely short duration flows through the surface layer of the conductor (skin effect), and the fuse element 5 is provided with a high melting point metal layer 10 such as Ag plating having a low resistance value as an outer layer, the current caused by a surge easily flows, and blowout due to self-heating can be prevented. Therefore, the fuse element 5 can significantly improve surge tolerance as compared with conventional fuses made of solder alloys.

The fuse element 5 can be manufactured by forming a high melting point metal layer 10 on the surface of the low melting point metal layer 9 using a film-forming technique such as an electrolytic plating method. For example, the fuse element 5 can be efficiently manufactured by applying Ag plating to the surface of the solder foil or the thread solder.

It should be noted that, in the fuse element 5, it is preferable that the volume of the low melting point metal layer 9 is larger than the volume of the high melting point metal layer 10. The fuse element 5 can melt and blow out promptly by eroding the high melting point metal by the low melting point metal melted by self-heating. Therefore, the fuse element 5 forms the low melting point metal layer 9 with a volume larger than that of the high melting point metal layer 10, thereby promoting this erosion and rapidly interrupting the connection between the terminal portions 5*a* and 5*b*.

Deformation Restricting Portion

As shown in FIG. 4 (A), the fuse element 5 may be provided with a deformation restricting portion 6 for restricting the flow of melted low melting point metal and restricting deformation. As a result of increasing the area of the fuse element 5, even in the fuse element 5 having a high rating and low resistance, deformation due to flow of the low-melting point metal during reflow heating can be suppressed, and fluctuation in the fusing characteristic can be prevented.

The deformation restricting portion 6 is provided on the surface of the fuse element 5, and as shown in FIG. 13, at least a part of a side surface 7*a* of one or more of holes 7 provided in the low melting point metal layer 9 is covered with the second high melting point metal layer 8 continuous to the high melting point metal layer 10. The holes 7 can be formed, for example, by piercing a sharp object such as a needle into the low melting point metal layer 9 or by performing press working on the low melting point metal layer 9 using a metal mold, among other methods. The hole 7 may have any shape such as an elliptical shape, or a rectangular shape, among other shapes. The hole 7 may be formed in the central portion of the fuse element 5, or may be formed uniformly over the entire surface. By forming the holes 7 at a position corresponding to the interrupting portion, the amount of metal melted in the interrupting portion can be reduced, the resistance can be increased, and interruption by heat can be performed more quickly.

As in the material constituting the high melting point metal layer 10, the material constituting the second high melting point metal layer 8 has a high melting point that does not melt at the reflow temperature. The second high melting point metal layer 8 is preferably formed of the same material as that of the high melting point metal layer 10 and formed simultaneously in the step of forming the high melting point metal layer 10 from the viewpoint of manufacturing efficiency.

First and Second Electrodes, and First and Second External Connection Electrodes The fuse element 5 may be connected to the first and second electrodes formed on the surface 2*a* of the base member 2 via a connecting material such as solder without providing the terminal portions 5*a* and 5*b*. In this case, first and second external connection electrodes electrically connected to the first and second electrodes are formed on the back surface and/or the side surface of the base member 2.

Leg

The cover member 3 has legs 35 formed at both ends of the third and fourth side walls 23 and 24. The fuse device 1 is provided with terminal portions 5*a*, 5*b* of the fuse element 5 between legs 35 formed at both ends of the side walls 23, 24, respectively, and the terminal portions 5*a*, 5*b* are connected to connection electrodes of an external circuit board on which the fuse device 1 is surface-mounted with a connection material for mounting, such as solder. Thus, even when a force is applied to the cover member 3 to slipping out in the direction opposite to the direction in which the fuse device 1 is inserted into the base member 2, the movement of the leg 35 is prevented by the terminal portions 5*a* and 5*b* of the fuse element 5 which are connected and fixed by the mounting connection material, thereby preventing the cover member 3 from slipping out.

It should be noted that, instead of forming the terminal portions 5*a* and 5*b* on the fuse element 5, in the case where the first and second electrodes are provided on the front surface of the base member 2 and the first and second external connection electrodes connected to the first and second electrodes are formed on the back surface and/or side surface, the cover member 3 exposes the first and second external connection electrodes on a side different from the side on which the second fitting projection 29 and/or the second side wall 22 is provided, to restrict the movement of the leg 35 by the first and second external connection electrodes and/or by the mounting connection material (fillet) connected to the first and second external connection electrodes when mounted on the external circuit board. Therefore, even when a force is applied to the cover member 3 to slip out in the direction opposite to the direction in which the cover member 3 is inserted into the base member 2, it is possible to prevent the cover member 3 from slipping out.

Figure 14A:
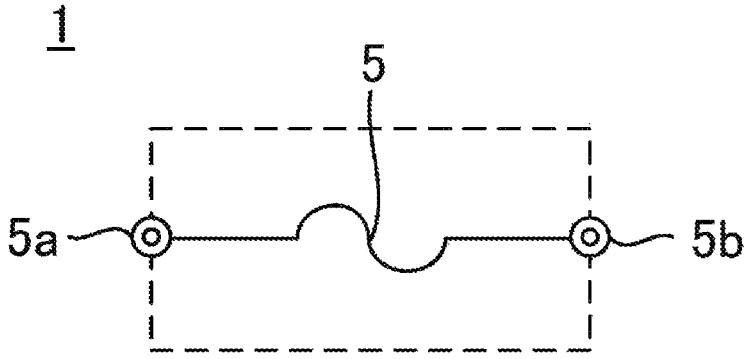
FIG. 14 is a circuit diagram of a fuse device, in which (A) shows the state before the fuse element is blown and (B) shows the state after the fuse element is blown.
Figure 14B:
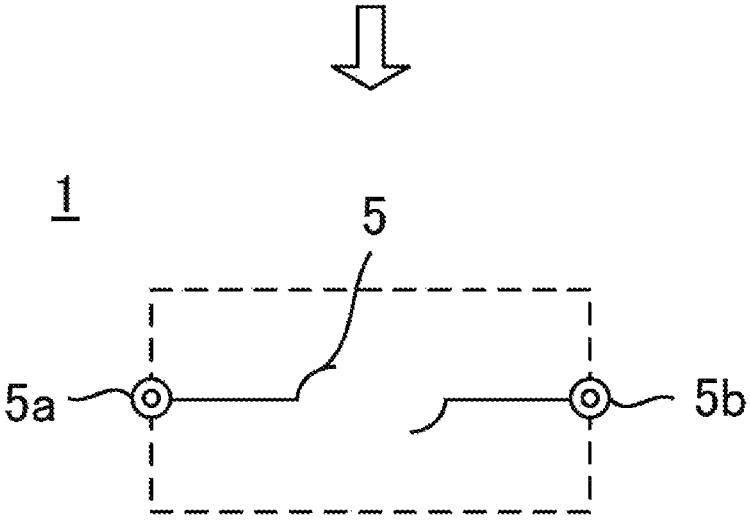

The fuse device 1 has the circuit configuration shown in FIG. 14 (A). The fuse device 1 is mounted on an external circuit via the terminal portions 5*a* and 5*b*, and is incorporated in a current path of the external circuit. The fuse device 1 is not blown by self-heating while a predetermined rated current flows through the fuse element 5. Then, when an overcurrent exceeding the rating current flows through the fuse device 1, the low thermal conductivity portion 15 is blown out by the self-heating of the fuse element 5 to disconnect the path between the terminal portions 5*a* and 5*b* thereby interrupting the current path of the external circuit (FIG. 14 (B)).

At this time, the fuse element 5 actively dissipates the heat generated by the high thermal conductivity portion 14 through the base member 2 and the cover member 3 as described above, and can selectively overheat the low thermal conductivity portion 15 formed along the grooves 12 and 26. Therefore, the fuse element 5 can blow out the low thermal conductivity portion 15 while suppressing the effect of heat on the terminal portions 5*a*, 5*b* or bonding material for mounting.

Further, as described above, since the second fitting projection 28 of the cover member 3 is fitted to the first opening 17 of the base member 2 in the fuse device 1, even if an pressure is suddenly applied to the cover member 3 upwardly from the surface 2*a* of the base member 2 when the fuse element 5 is interrupted by self-heating due to overcurrent while generating arc discharge, by fixing the second fitting projection 29 with the abutment surface 11*b* continuous with the first opening 17, the resistance to the upward pressure from the surface 2*a* of the base member 2 is improved, thereby preventing the cover member 3 from being disengaged from the base member 2.

In addition, because the device includes the low melting point metal layer 9 having a melting point lower than that of the high melting point metal layer 10, the low melting point metal layer 9 starts to melt from the melting point thereof by self-heating due to overcurrent and starts to erode the high melting point metal layer 10. Therefore, in the fuse element 5, by utilizing the erosion action of the high melting point metal layer 10 by the low melting point metal layer 9, the high melting point metal layer 10 is melted at a temperature lower than the melting point thereof, thereby achieving quick blowout.

Materials of the Base Member and the Cover Member

In the fuse device 1, the base member and the cover member are preferably made of a plastic material having a tracking resistance of 250V or more. This is due to the following circumstances.

Due to recent environmental demands, halogen-free electronic components have been developed, and halogen-free LCP has replaced the material of the fuse element housing. Here, the application of this type of fuse device is extended from electronic appliances to high current applications such as industrial machines, electric bicycles, electric bikes, and cars, among others. Therefore, with the increase in capacity and rating of electronic appliances and battery packs to be mounted, fuse devices are required to further improve the current rating.

In order to increase the current rating, it is effective to reduce the resistance by increasing the size of the fuse element. However, when an overcurrent exceeding the rating flows through an fuse element, the fuse element melts while generating an arc discharge. Therefore, as the fuse element is increased in size, the heat generated by arc discharge increases in proportion to the increase in size.

Further, with the increase in the current rating, the amount of heat generated at the time of the self-heating interruption by the overcurrent also increases, and the thermal influence on the element housing also increases. For example, when the current rating of the fuse element rises to 100 A level and the voltage rating rises to 60V level, the surface of the element housing opposing the fuse element is carbonized by arc discharge at the time of current interruption, and leakage current flows to reduce the insulation resistance, or the element housing is damaged by ignition, or the element housing is displaced from the mounted substrate or falls off. This is because the aromatic ring in the main chain of the liquid crystal polymer is carbonized by arc discharge.

As a measure to stop the arc discharge immediately and interrupt the circuit, there have also been proposed high voltage compatible current fuses such as fuses having arc extinguishing material packed into a hollow case and fuses in which fuse elements are helically wrapped around a heat dissipation material to generate a time lag. However, either of the conventional high voltage current fuses requires complicated materials and processes such as encapsulation of arc-extinguishing material and manufacturing of a helical fuse, which are disadvantageous in terms of miniaturization of fuse devices and high current rating.

Further, by using a non-combustible inorganic material such as a ceramic material as the element housing material, it is possible to suppress a decrease in insulation resistance and ignition; this approach, however, involves disadvantages in that the material cost and the process cost increase.

In view of this, there is a need for a fuse device capable of coping with high-rated and high-current applications, which has excellent arc resistance at the time of current interruption, and which can improve insulation resistance and prevent the element housing from falling off the mounting substrate.

In the fuse device according to the present technology, the base member 2 and the cover member 3 constituting the element housing are formed of a plastic material having a tracking resistance of 250V or more, so that even if an arc discharge occurs when the fuse element is blown, decrease in insulation resistance due to the occurrence of current leakage caused by carbonization of the base member and the cover member is prevented, ignition due to a tracking phenomenon is prevented, and the element housing can be prevented from disengaged or falling off from the mounting substrate on which the element housing is surface mounted.

The plastic material constituting the base member 2 and the cover member 3 is preferably a nylon type material. By using a nylon type plastic material, the tracking resistance of the base member 2 and the cover member 3 can be set to 250V or more. This tracking resistance can be determined by testing in accordance with IEC 60112.

Among the nylon type plastic materials, nylon 46 is particularly preferable to constitute the base member 2 and the cover member 3. This can increase the tracking resistance of the fuse device 1 to 600V or more.

As described above, in the fuse device 1, the second fitting projection 29 formed in the cover member 3 is fitted into the first opening 17 formed in the first side wall 11 of the base member 2, and the first fitting projection 18 formed in the base member 2 is fitted into the second opening 28 formed in the second side wall 22 of the cover member 3.

Thus, in the fuse device 1, the abutment surface 11*b* of the fitting recess 11*a* contacts the upper surface of the second fitting projection 29 (FIG. 1), and the abutment surface 22*b* of the fitting recess 22*a* contacts the lower surface of the first fitting projection 18 (FIG. 3). Therefore, in the fuse device 1, even when an pressure is suddenly applied to the cover member 3 upwardly from the surface 2*a* of the base member 2 when the fuse element 5 is interrupted by self-heating due to overcurrent while generating arc discharge, by fixing the second fitting projection 29 with the abutment surface 11*b* continuous with the first opening 17, and by fixing the first fitting projection 18 with the abutment surface 22*b* continuous with the second opening 28, the resistance to the upward pressure from the surface 2*a* of the base member 2 is improved.

In the fuse device 1, the base member 2 and the cover member 3 constituting the element housing are formed of a plastic material having a tracking resistance of 250V or more, preferably a polyamide resin, and more preferably an aliphatic polyamide resin. As a result, even when the fuse element used in a high-current application is subject to arc discharge at the time of interruption and generates high heat, it is possible to prevent decrease in insulation resistance due to the occurrence of current leakage caused by carbonization of the base member 2 and the cover member 3 and also prevent ignition due to a tracking phenomenon.

Examples of the aliphatic polyamide resin include polyamide 46 (melting point: 290° C., glass transition temperature: 78° C.), polyamide 66 (melting point: 262° C., glass transition temperature: 66° C.), and polyamide 6 (melting point: 222° C., glass transition temperature: 59° C.). Among these, a polyamide 46 having a high melting point and a high glass transition temperature is particularly preferable. By using this, even if arc discharge is generated when the fuse element applicable to a large current is blown and the temperature of the inside of the element housing 4 becomes high, excellent resistance to deformation caused by thermal effects can maintain the fitting strength between the first opening 17 of the base member 2 and the second fitting projection 29 of the cover member 3, and the fitting strength between the second opening 28 of the cover member 3 and the first fitting projection 18 of the base member 2.

Table 1 shows comparison between the main characteristics of HF nylon and LCP.

TABLE 1

| material | LCP | HF nylon PA 46 |
|---|---|---|
| halogen-free | YES | YES |
| incombustibility | V-0 | V-0 |
| melting point | 340° C. | 305° C. |
| tracking resistance | 125 V | 600 V |

As shown in Table 1, it can be seen that aliphatic polyamide resins, especially polyamide 46, have the same performance in terms of combustibility and melting point as compared with LCP, and have extremely excellent properties in terms of tracking resistance.

It should be noted that, in the fuse device 1, the first to fourth locking pieces 19*a*, 19*b*, 30*a*, 30*b* locked to the locking step portions 17*a*, 28*a* of the first and second openings 17, 28 are also made of a highly tracking-resistant plastic material such as polyamide 46, so that they are prevented from falling out of the locking step portions 17*a*, 28*a* due to softening even in a high-temperature environment caused by arc discharge, and are resistant to the pressure in a direction parallel with the plane of the surface 2*a* of the base member 2. Therefore, the fuse device 1 can maintain the engagement between the base member 2 and the cover member 3.

Examples

The tracking resistance tests using different plastic materials constituting the element housing 4 will be described. The fuse device 1 described above was manufactured using LCP and HF nylon PA 46, and an overcurrent test was performed. As fuse elements mounted on each fuse device sample, a fuse element having an inner layer constituted by an Sn—Ag—Cu solder foil (Sn: Ag: Cu=96.5 mass %: 3.0 mass %: 0.5 mass %) having a thickness of 200 μm serving as a low melting point metal on which Ag was plated by electrolytic plating to laminate a high melting point metal layer. Also, eight fuse element samples made of LCP and eight fuse element samples made of HF nylon were prepared, and a current of 200 A and 36V were applied to blow the fuse elements, and the insulation resistance after the blow was measured.

TABLE 2

| material | LCP | HF nylon PA 46 |
|---|---|---|
| minimum insulation resistance | less than 1.0E+6Ω | 1.1E+11Ω |

As shown in Table 2, the fuse element made of LCP had a minimum insulation resistance of less than 1.0E+6Ω, while the fuse element made of HF nylon had a minimum insulation resistance of 1.1E+11Ω. That is, in the fuse element made of HF nylon, the combustion tendency is small, and it can be seen that the insulating property can be maintained even when an arc discharge occurs due to the blow of the fuse element. It should be noted that the minimum insulation resistance was set to less than 1.0E+6Ω since there were some samples in which the insulation resistance could not be measured (range over) in LCP.

Heat-Generating Element

Figure 15A:
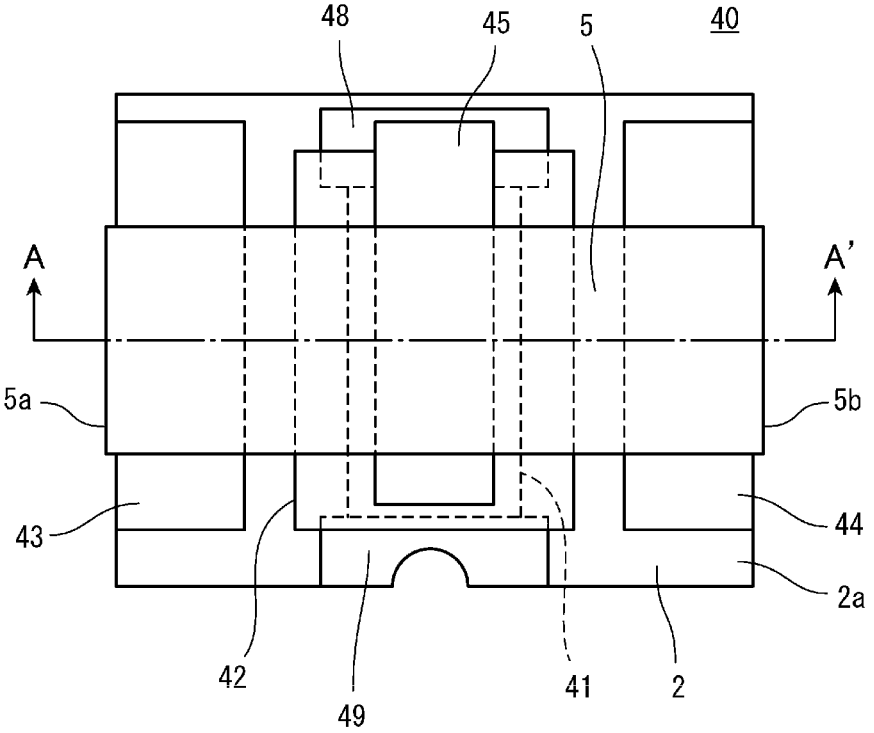
FIG. 15 is a diagram showing a fuse element provided with a heat-generating element, in which (A) is a plan view and (B) is a cross-sectional view.
Figure 15B:
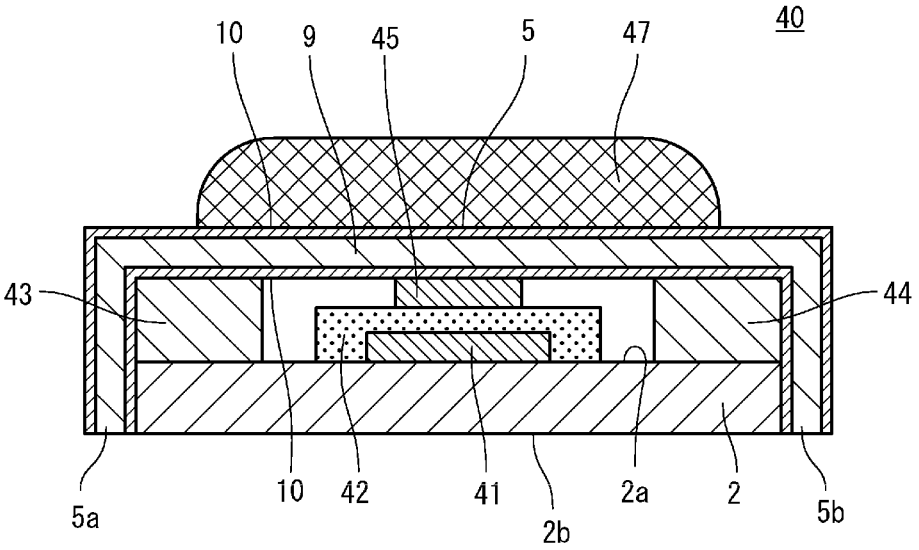

As shown in FIGS. 15 (A) and (B), the present technology can also be applied to a fuse device 40 having a base member 2 provided with a heat-generating element 41. In the following description, the same members as those of the fuse device 1 are denoted by the same reference numerals and the details thereof are omitted. The fuse device 40 includes a base member 2, a heat-generating element 41 laminated on the base member 2 and covered with an insulating member 42, a first electrode 43 and a second electrode 44 formed on both ends of the base member 2, a heat-generating element extraction electrode 45 laminated on the base member 2 so as to be superposed on the heat-generating element 41 and electrically connected to the heat-generating element 41, and a fuse element 5 both ends of which are connected to the first and second electrodes 43, 44, and a central portion of which is connected to the heat-generating element extraction electrode 45. The fuse device 40 forms the element housing 4 by bonding or fitting the base member 2 and the cover member 3 to each other.

On the surface 2*a* of the base member 2, the first and second electrodes 43 and 44 are formed on mutually opposite ends. The first and second electrodes 43 and 44 interrupt the current path between the terminal portions 5*a* and 5*b* when the heat-generating element 41 is energized to generate heat and the melted fuse element 5 gathers together due to the wettability thereof.

The heat-generating element 41 is made of a electrically conductive material that generates heat when energized, and is made of, for example, nichrome, W, Mo, Ru, or a material containing these. The heat-generating element 41 can be formed by, for example, forming a paste by mixing powder of these alloys, compositions, or compounds with a resin binder, patterning the paste on the base member 2 using a screen printing technique, and baking the paste.

In the fuse device 40, a heat-generating element 41 is covered with an insulating member 42, and a heat-generating element extraction electrode 45 is formed so as to face the heat-generating element 41 via the insulating member 42. The fuse element 5 is connected to the heat-generating element extraction electrode 45, whereby the heat-generating element 41 overlaps the fuse element 5 via the insulating member 42 and the heat-generating element extraction electrode 45. The insulating member 42 is provided to protect and insulate the heat-generating element 41 and to efficiently transmit the heat of the heat-generating element 41 to the fuse element 5, and is made of, for example, a glass layer.

The heat-generating element 41 may be formed inside the insulating member 42 laminated on the base member 2. The heat-generating element 41 may be formed on the back surface 2*b* opposite to the front surface 2*a* of the base member 2 on which the first and second electrodes 43 and 44 are formed, or may be formed adjacent to the first and second electrodes 43 and 44 on the front surface 2*a* of the base member 2. The heat-generating element 41 may be formed inside the base member 2.

Further, one end of the heat-generating element 41 is connected to the heat-generating element extraction electrode 45 via the first heat-generating element electrode 48 formed on the surface 2*a* of the base member 2, and the other end is connected to the second heat-generating element electrode 49 formed on the surface 2*a* of the base member 2. The heat-generating element extraction electrode 45 is connected to the first heat-generating element electrode 48 and laminated on the base member 2 so as to face the heat-generating element 41, and is connected to the fuse element 5. Thus, the heat-generating element 41 is electrically connected to the fuse element 5 via the heat-generating element extraction electrode 45. It should be noted that positioning the heat-generating element extraction electrode 45 to face the heat-generating element 41 via the insulating member 42 not only allows the fuse element 5 to be melted but also promotes gathering of melted conductor.

Figure 16B:
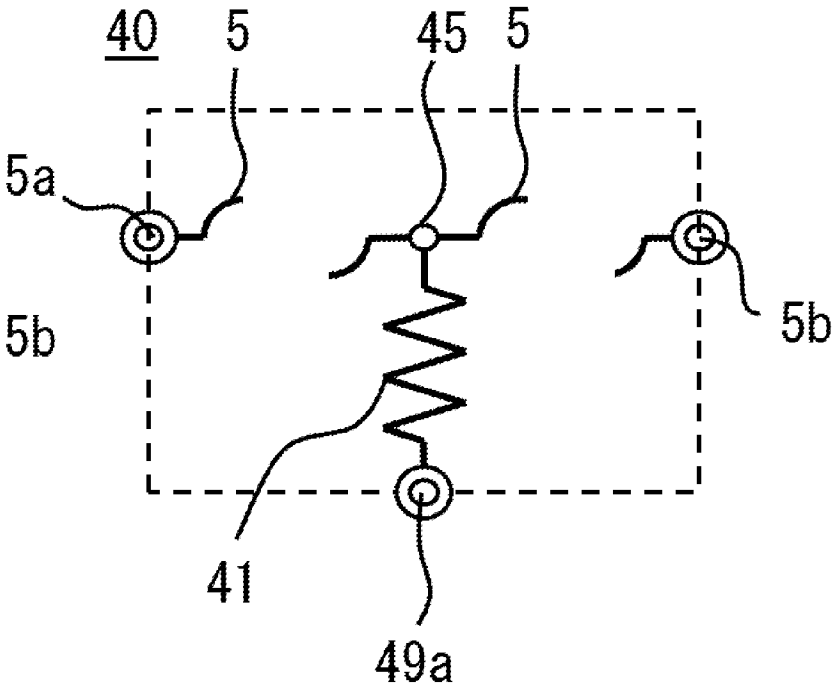
FIG. 16 is a circuit diagram of a fuse device, in which (A) shows the state before the fuse element is blown and (B) shows the state after the fuse element is blown.
Figure 16A:
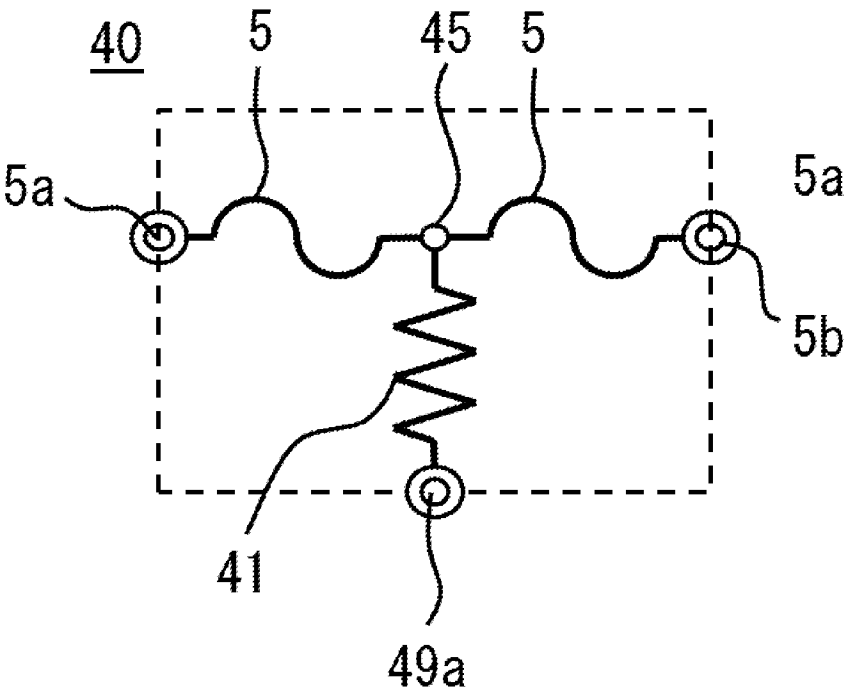

The second heat-generating element electrode 49 is formed on the front surface 2*a* of the base member 2, and is continuous with a heat-generating element power supply electrode 49*a* formed on the back surface 2*b* of the base member 2 through a castellation (FIG. 16 (A)).

In the fuse device 40, the fuse element 5 is connected from the first electrode 43 to the second electrode 44 via the heat-generating element extraction electrode 45. The fuse element 5 is connected to the first and second electrodes 43 and 44 and the heat-generating element extraction electrode 45 via a connecting material such as a connecting solder.

Flux

Further, in the fuse device 40, in order to prevent oxidation and sulfidation of the high melting point metal layer 10 or the low melting point metal layer 9, remove oxides and sulfides during melting, and improve the fluidity of the solder, the top surface and the back surface of the fuse element 5 may be coated with a flux 47. Coating with the flux 47 not only improves the wettability of the low melting point metal layer 9 (for example, solder) but also removes oxides and sulfides generated while the low melting point metal is melted, and improves blowout properties by the erosion action on the high melting point metal (for example, Ag) during actual use of the fuse device 40.

Further, by coating with the flux 47, even when an antioxidant film such as a Pb-free solder containing Sn as the main component is formed on the surface of the outermost high melting point metal layer 10, oxides of the antioxidant film can be removed, oxidation and sulfidation of the high melting point metal layer 10 can be effectively prevented, and blowout properties can be maintained and improved.

It is preferable that the first and second electrodes 43, 44, the heat-generating element extraction electrodes 45, and the first and second heat-generating element electrodes 48, 49 are formed by a conductive pattern such as of Ag or Cu, and a protective layer such as Sn plating, Ni/Au plating, Ni/Pd plating, Ni/Pd/Au or other plating is formed on the surface as appropriate. This prevents oxidation and sulfidation of the surface and suppress erosion of the first and second electrodes 43, 44 as well as the heat-generating element extraction electrode 45 caused by connecting material such as solder used to connect the fuse element 5.

Further, the fuse device 40 constitutes a part of an current path to the heat-generating element 41 by connecting the fuse element 5 to the heat-generating element extraction electrode 45. Therefore, when the fuse element 5 melts and the connection with the external circuit is interrupted, the fuse device 40 also interrupts the current path to the heat-generating element 41, so that heat generation can be stopped.

Circuit Diagram

The fuse device 40 according to the present invention has a circuit configuration as shown in FIG. 16. Thus, the fuse device 40 has a circuit configuration in which the fuse element 5 is connected in series between a pair of terminal portions 5*a* and 5*b* via the heat-generating element extraction electrode 45, and a heat-generating element 41 is connected to the fuse element 5 via a connection point through which current passes to generate heat and melt the the fuse element 5. In the fuse device 40, the terminal portions 5*a* and 5*b* provided at both ends of the fuse element 5 and the heat-generating element power supply electrode 49*a* connected to the second heat-generating element electrode 49 are connected to an external circuit board. Thus, in the fuse device 40, the fuse element 5 is connected in series to the current path of the external circuit via the terminal portions 5*a* and 5*b*, and the heat-generating element 41 is connected to the current control element provided in the external circuit via the heat-generating element power supply electrode 49*a*.

Blowout Process

When the fuse device 40 having such a circuit configuration needs to interrupt the current path of the external circuit, a current control element provided in the external circuit energizes the heat-generating element 41. As a result, in the fuse device 40, the fuse element 5 incorporated in the current path of the external circuit is melted by the heat generated by the heat-generating element 41, and the highly wettable heat-generating element extraction electrode 45 and the first and second electrodes 43 and 44 attract the melted conductor of the fuse element 5 to blow out the fuse element 5. As a result, the fuse element 5 is reliably blown between the terminal portion 5*a* and the heat-generating element extraction electrode 45, and between the heat-generating element extraction electrode 45 and the terminal portion 5*b*, thereby reliably interrupting the current path of the external circuit (FIG. 16 (B)). Moreover, blowing the fuse element 5 also interrupts the power supply to the heat-generating element 41.

During this, heat generation of the heat-generating element 41 starts to melt the fuse element 5 from the melting point of the low melting point metal layer 9 having a melting point lower than that of the high melting point metal layer 10 and the the low melting point metal layer 9 begins to erode the high melting point metal layer 10. Thus, in the fuse element 5, the high melting point metal layer 10 is melted at a temperature lower than the melting point by utilizing the erosion action of the high melting point metal layer 10 by the low melting point metal layer 9, and the current path of the external circuit can be rapidly interrupted.

By using a plastic material having an excellent tracking resistance for the base member 2 and the cover member 3, it is possible to prevent decrease in insulation resistance due to current leakage caused by carbonization of the base member 2 and the cover member 3 and also to prevent ignition caused by a tracking phenomenon when the fuse element 5 is melted and interrupted.

It should be noted that, although the fuse devices 1 and 40 described above are surface-mounted on an external circuit board by connecting the terminal portions 5*a* and 5*b* of the fuse element 5 to external connection terminal portions provided on the external circuit board by soldering, the fuse devices 1 and 40 according to this technology can be used with connections other than surface mounting.

For example, in the fuse devices 1 and 40 according to the present technology, the terminal portions 5*a* and 5*b* of the fuse element 5 may be connected to a metal plate serving as an external connection terminal capable of supporting a large current. The terminal portions 5*a* and 5*b* of the fuse element 5 may be connected to the metal plate by connecting material such as solder, the terminal portions 5*a* and 5*b* may be held by a clamp terminal connected to a metal plate, or the terminal portions 5*a* and 5*b* or the clamp terminal may be fixed by screws having conductivity to the metal plate.

Modified Example of Fuse Element

Next, a modification of the fuse device according to the present invention will be described. It should be noted that, in the following description, the same members as the fuse devices 1 and 40 are denoted by the same reference numerals, and the details thereof are not explained.

Figures 17A, 17B, 17C, 17D, 17E:
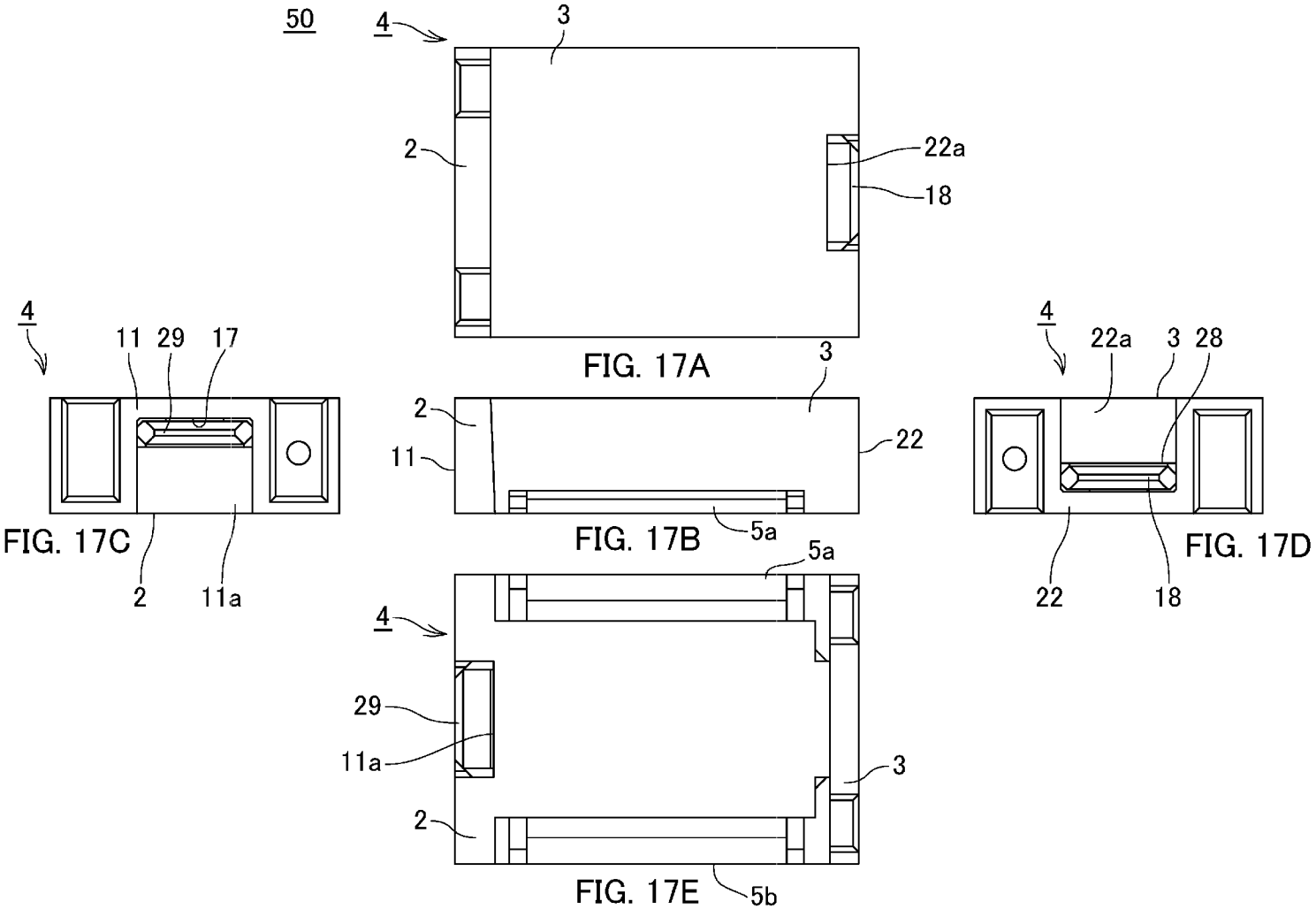
FIG. 17 (A) is a plan view of a fuse device viewed from the cover member side, FIG. 17 (B) is a side view of the fuse device, FIG. 17 (C) is a rear view of the fuse device, FIG. 17 (D) is a front view of the fuse device, and FIG. 17 (E) is a back view of the fuse device viewed from the base member side.

As shown in FIG. 17, the fuse device 50 according to the present invention has a base member 2 and a cover member 3 that covers a surface 2*a* of the base member 2. The base member 2 and the cover member 3 are fitted to each other to form an element housing 4. It should be noted that FIG. 17 (A) is a plan view of a fuse device 50 viewed from the cover member 3 side, FIG. 17 (B) is a side view of the fuse device 50, FIG. 17 (C) is a rear view of the fuse device 50, FIG. 17 (D) is a front view of the fuse device 50, and FIG. 17 (E) is a rear view of the fuse device 50 viewed from the base member 2 side.

Base Member

As shown in FIGS. 18 to 22, the base member 2 has the fuse element 5 mounted on the surface 2*a*, and provided on one side edge with a first side wall 11 intersecting with the plane of the surface 2*a* and constitutes a side surface of the element housing 4. The first side wall 11 is provided with a fitting recess 11*a* and there are formed, in the fitting recess 11*a*, a first opening 17 that receives a second fitting projection 29 formed on the cover member 3 as described later and an abutment surface 11*b* that is continuous with the first opening 17 and abuts on the second fitting projection 29 inserted into the first opening 17.

Figure 18:
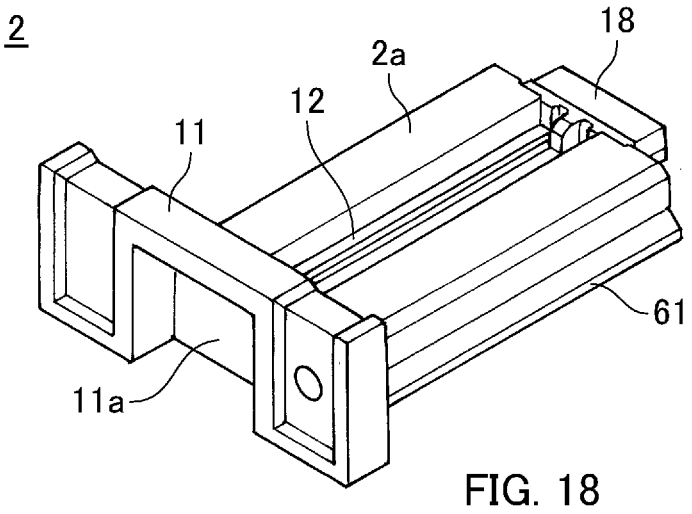
FIG. 18 is an external perspective view illustrating the base member viewed from the first side wall side.
Figure 19:
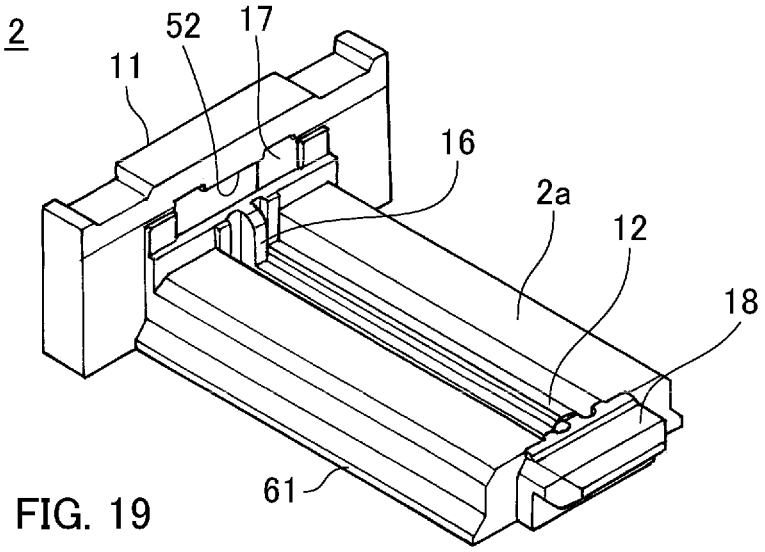
FIG. 19 is an external perspective view illustrating the base member viewed from the first fitting projection side.
Figure 20:
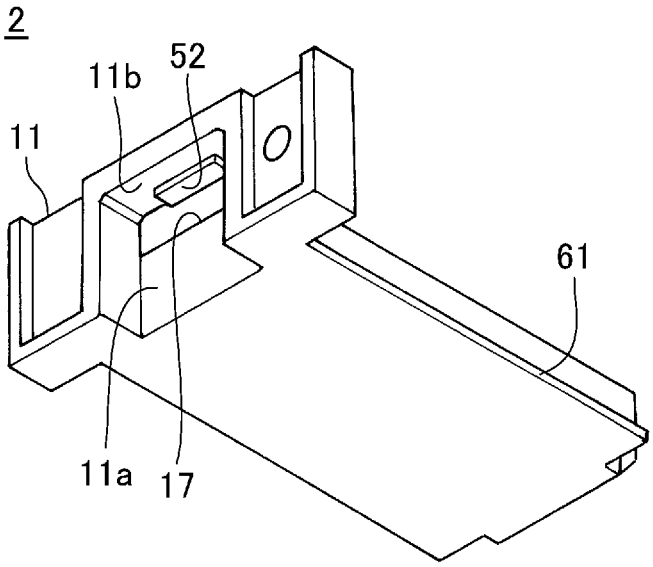
FIG. 20 is an external perspective view illustrating the back surface of the base member viewed from the first side wall side.
Figure 21:
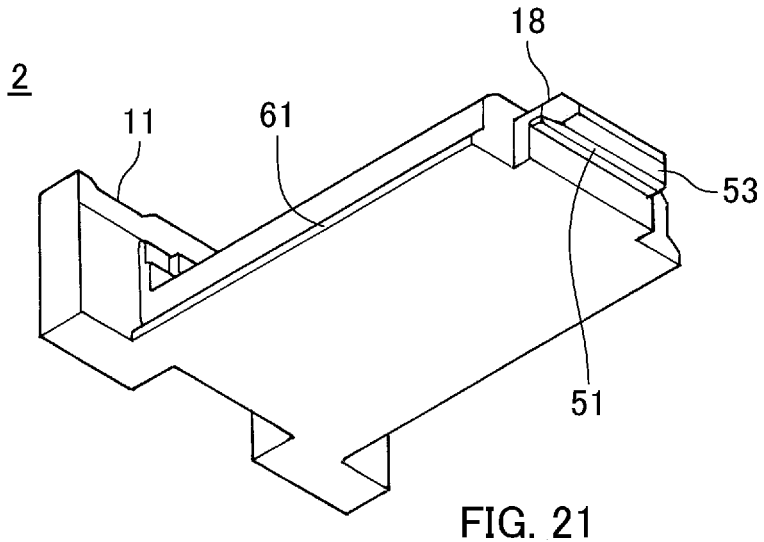
FIG. 21 is an external perspective view illustrating the back surface of the base member viewed from the first fitting projection side.
Figure 22A:
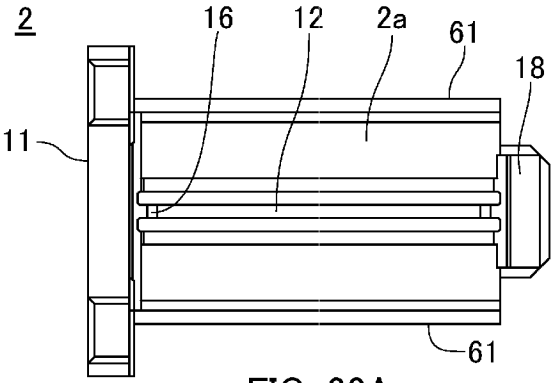
FIG. 22 (A) is a plan view of a base member, FIG. 22 (B) is a side view of the base member, FIG. 22 (C) is a rear view of the base member, FIG. 22 (D) is a front view of the base member, and FIG. 22 (E) is a back view of the base member.
Figure 22B:
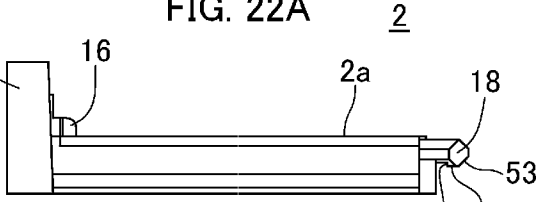
Figure 22E:
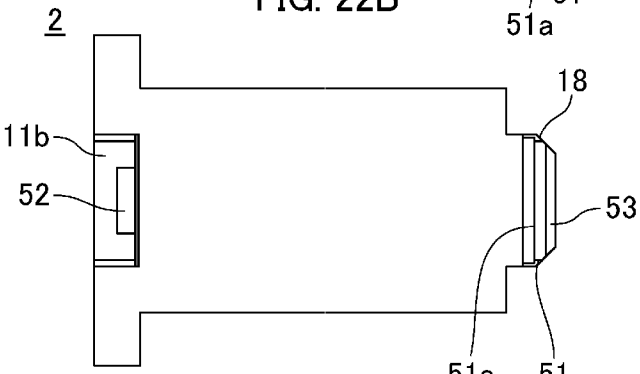
Figure 22D:
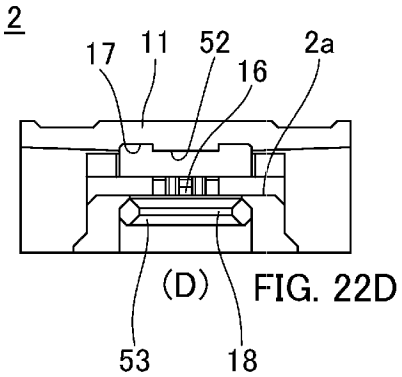
Figure 22C:
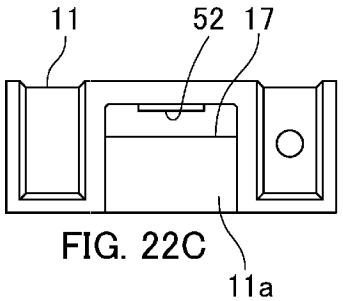

It should be noted that FIG. 18 is an external perspective view illustrating the base member 2 viewed from the first side wall 11 side, FIG. 19 is an external perspective view illustrating the base member 2 viewed from the first fitting projection 18 side, FIG. 20 is an external perspective view illustrating the back surface of the base member 2 viewed from the first side wall 11 side, and FIG. 21 is an external perspective view illustrating the back surface of the base member 2 viewed from the first fitting projection 18 side. In addition, FIG. 22 (A) is a plan view of a base member 2, FIG. 22 (B) is a side view of the base member 2, FIG. 22 (C) is a rear view of the base member 2, FIG. 22 (D) is a front view of the base member 2, and FIG. 22 (E) is a back view of the base member 2.

In addition, on the other side edge of the base member 2 of the fuse device 50 opposite to the one side edge on which the first side wall 11 is provided, there are formed a first fitting projection 18 that protrudes outward from a plane intersecting with the plane of the surface 2*a* of the base member 2 and fits in a second opening 28 formed in a second side wall 22 formed in the cover member 3 as described later. The first fitting projection 18 preferably extends outward along a plane parallel with the surface 2*a* of the base member 2.

Cover Member

As shown in FIGS. 23 to 27, the cover member 3 includes a second side wall 22 constituting a side surface facing the first side wall 11 of the element housing 4; third and fourth side walls 23, 24 provided in the direction of current flow of the fuse element 5 and with the terminal portions 5*a*, 5*b* exposed to the outside; and a top surface 25 constituting the top surface of the element housing 4.

Figure 23:
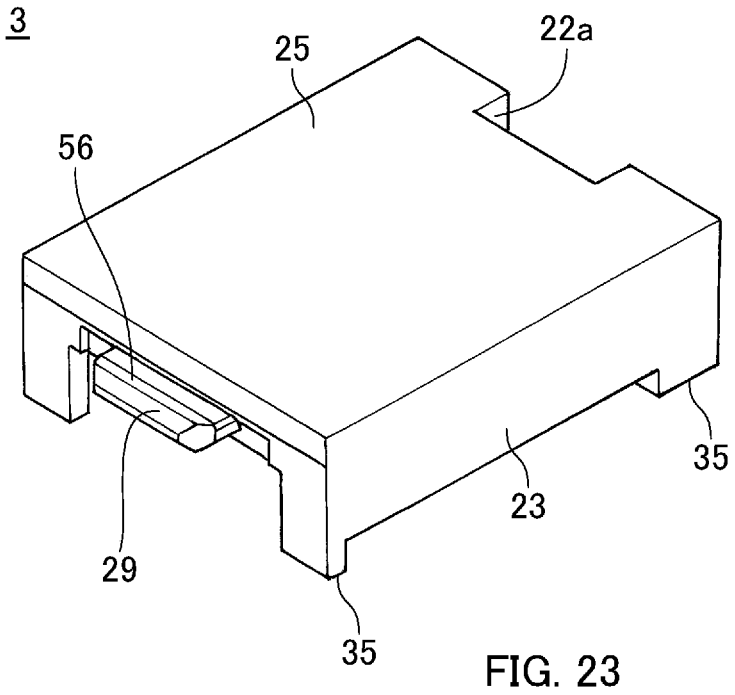
FIG. 23 is an external perspective view illustrating the cover member viewed from the second fitting projection side.
Figure 24:
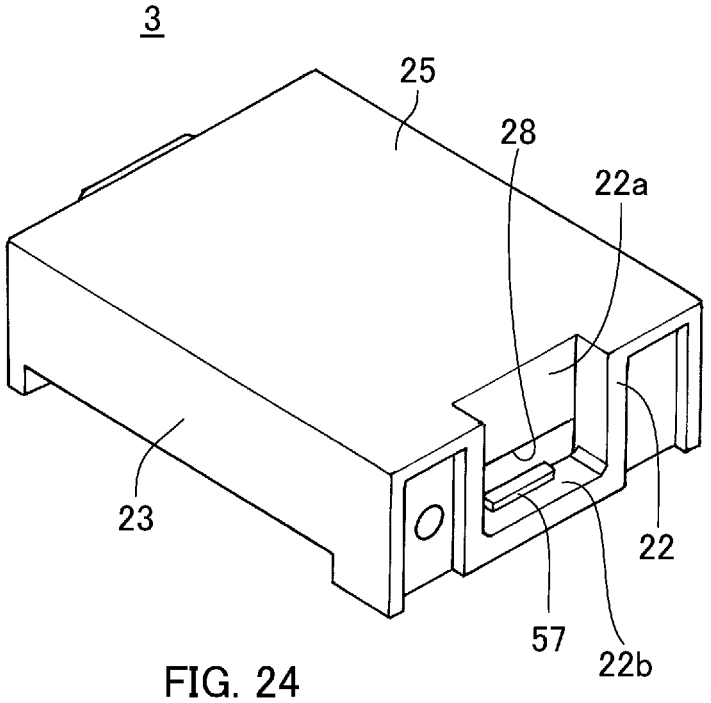
FIG. 24 is an external perspective view illustrating the cover member viewed from the second side wall side.
Figure 25:
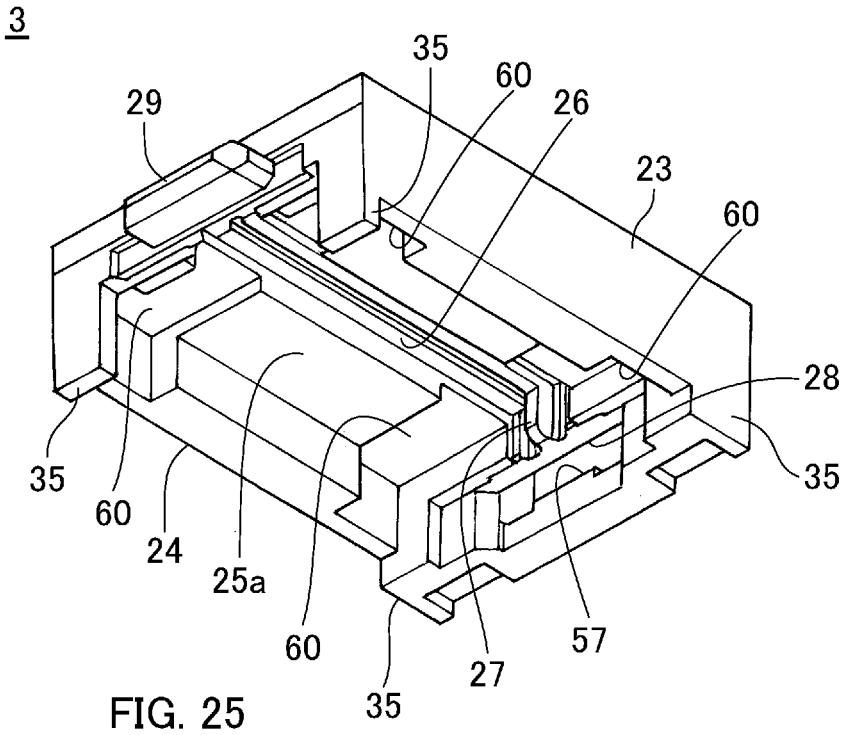
FIG. 25 is an external perspective view illustrating the inner surface of the cover member viewed from the second fitting projection side.
Figure 26:
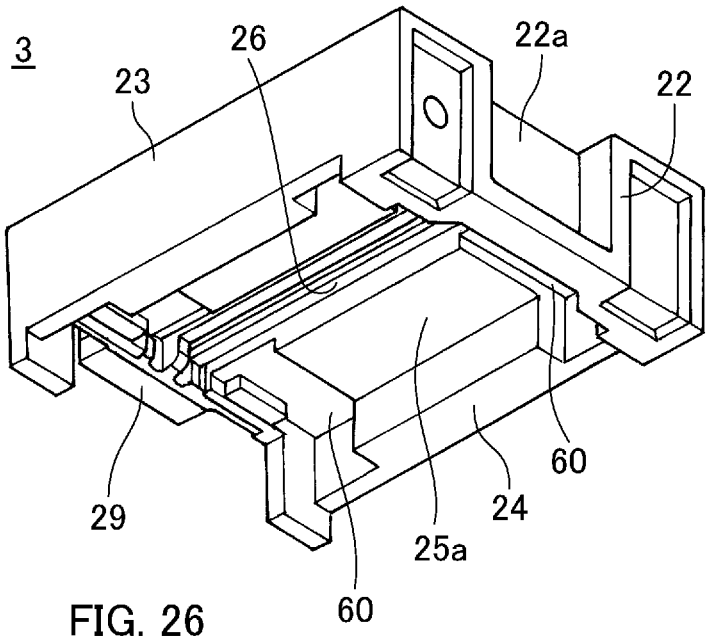
FIG. 26 is an external perspective view illustrating the inner surface of the cover member viewed from the second side wall side.
Figure 27A:
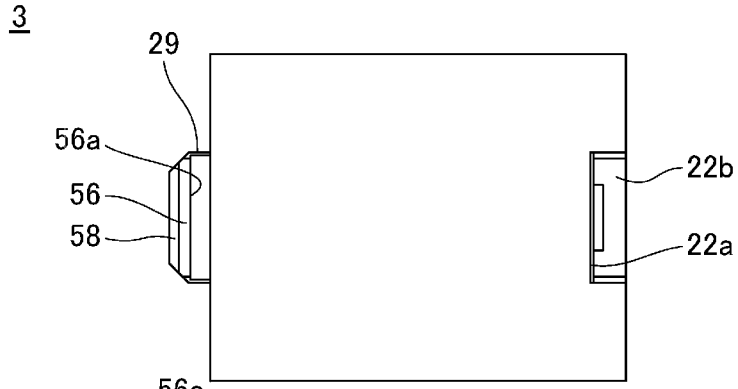
FIG. 27 (A) is a plan view of a cover member, FIG. 27 (B) is a side view of the cover member, FIG. 27 (C) is a rear view of the cover member, FIG. 27 (D) is a front view of the cover member, and FIG. 27 (E) is a back view of the cover member.
Figure 27B:
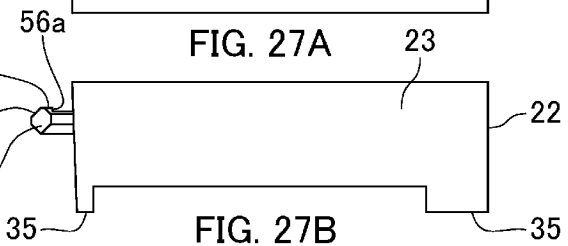
Figure 27E:
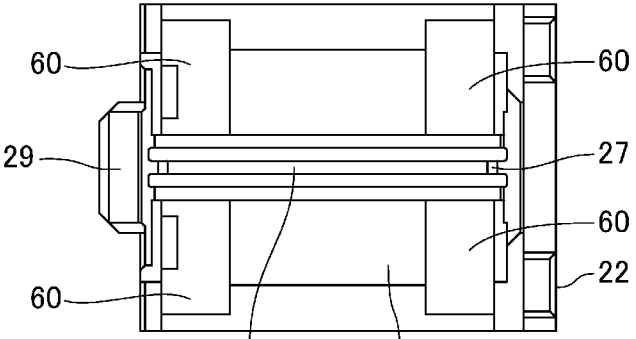
Figure 27C:
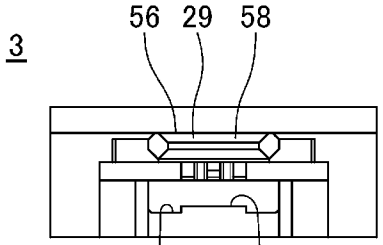
Figure 27D:
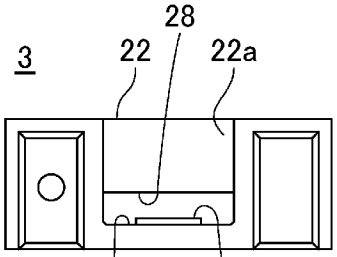

It should be noted that FIG. 23 is an external perspective view illustrating the cover member 3 viewed from the second fitting projection 29 side, FIG. 24 is an external perspective view illustrating the cover member 3 viewed from the second side wall 22 side, FIG. 25 is an external perspective view illustrating the inner surface of the cover member 3 viewed from the second fitting projection 29 side, and FIG. 26 is an external perspective view illustrating the inner surface of the cover member 3 viewed from the second side wall 22 side. In addition, FIG. 27 (A) is a plan view of a cover member 3, FIG. 27 (B) is a side view of the cover member 3, FIG. 27 (C) is a rear view of the cover member 3, FIG. 27 (D) is a front view of the cover member 3, and FIG. 27 (E) is a back view of the cover member 3.

On one side edge side of the cover member 3, a second side wall 22 is erected in a direction intersecting, preferably substantially perpendicular to the plane of the surface 2*a* of the base member 2 to constitute a side surface of the element housing 4. The second side wall 22 is provided with a fitting recess 22*a*, and in this fitting recess 22*a*, there are formed a second opening 28 that receives a first fitting projection 18 formed on the base member 2 as described above and an abutment surface 22*b* that is continuous with the second opening 28 and abuts on the first fitting projection 18 inserted into the second opening 28.

In addition, on the other side edge of the cover member 3 of the fuse device 50 opposite to the one side edge on which the second side wall 22 is provided, there are formed a second fitting projection 29 that protrudes outward from a plane intersecting with the plane of the surface 2*a* of the base member 2 and fits in the first opening 17 formed in the first side wall 11 formed in the base member 2 as described above. The second fitting projection 29 preferably protrudes outward along a plane parallel with the surface 2*a* of the base member 2.

In the fuse device 50, the second fitting projection 29 formed on the cover member 3 is fitted into the first opening 17 formed in the first side wall 11 of the base member 2, and the first fitting projection 18 formed on the base member 2 is fitted into the second opening 28 formed in the second side wall 22 of the cover member 3.

As in the fuse device 1 described above, in the fuse device 50, when the second fitting projection 29 of the cover member 3 is fitted into the first opening 17 of the base member 2, an abutment surface 11*b* of the fitting recess 11*a* abuts on the upper surface of the second fitting projection 29. In addition, when the first fitting projection 18 of the base member 2 is fitted into the second opening 28 of the cover member 3, an abutment surface 22*b* of the fitting recess 22*a* abuts on the lower surface of the first fitting projection 18.

As a result, even when an pressure is suddenly applied to the cover member 3 upwardly from the surface 2*a* of the base member 2 when the fuse element 5 is interrupted by self-heating due to overcurrent while generating arc discharge, by fixing the second fitting projection 29 with the abutment surface 11*b* continuous with the first opening 17, and fixing the first fitting projection 18 with the abutment surface 22*b* continuous with the second opening 28, the resistance to the upward pressure from the surface 2*a* of the base member 2 is improved, thereby preventing the cover member 3 from being disengaged from the base member 2.

Figure 28:
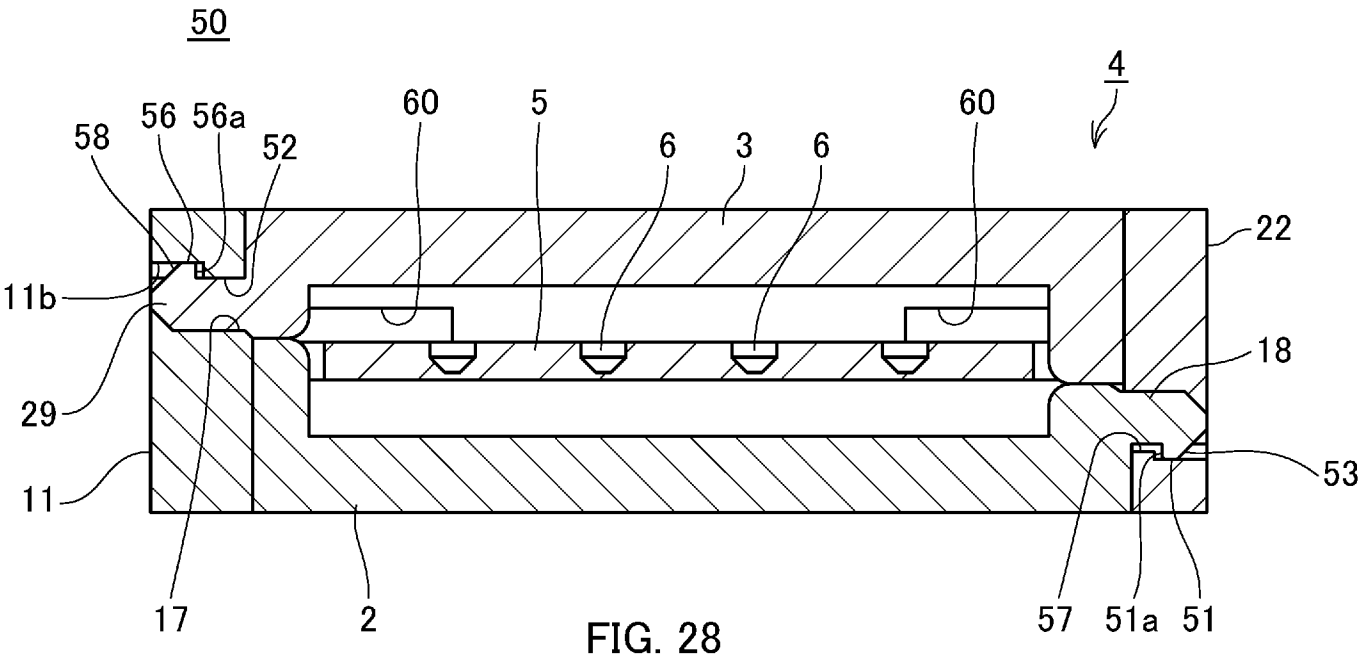
FIG. 28 is a cross-sectional view illustrating a state in which a first fitting claw and a second protruded surface, and a second fitting claw and a first protruded surface are engaged with each other.

As shown in FIG. 28, in the fuse device 50, by forming, at one side edge intersecting with the plane of the surface 2*a* of the base member 2, an opening on at least one of the base member 2 and the cover member 3 and a fitting projection on the other one, resistance to the upward pressure from the surface 2*a* of the base member 2 can be improved; preferably, however, by forming openings and fitting projections in each of the base member 2 and the cover member 3 to achieve mutual fitting, the cover member 3 can be more reliably prevented from disengaged from the base member 2.

Fitting Claw/Protruded Surface

In the fuse device 50, the first fitting projection 18 of the base member 2 is provided with a first fitting claw 51 which bulges in a direction intersecting the direction of insertion into the second opening 28 formed in the second side wall 22. In addition, in the fuse device 50, the cover member 3 is provided with a second protruded surface 57, which bulges in a direction intersecting the inserting direction of the first fitting projection 18, on the abutment surface 22*b* of the second opening 28.

Similarly, the second fitting projection 29 of the cover member 3 is provided with a second fitting claw 56 which bulges in a direction intersecting the direction of insertion into the first opening 17 formed in the first side wall 11. In addition, in the fuse device 50, the base member 2 is provided with a first protruded surface 52, which bulges in a direction intersecting the inserting direction of the second fitting projection 29, on the abutment surface 11*b* of the first opening 17.

As shown in FIG. 28, the first fitting claw 51 and the second protruded surface 57, as well as the second fitting claw 56 and the first protruded surface 52 are engaged with each other to prevent the cover member 3 from slipping out in a direction parallel with the plane of the surface 2*a* of the base member 2.

The second fitting claw 56 is formed on a surface facing the abutment surface 11*b* when the second fitting projection 29 is inserted into the first opening 17 so as to bulge in the width direction of the second fitting projection 29. Further, the second fitting claw 56 is provided with a second fitting surface 56*a* that passes over and locks the first protruded surface 52 when the second fitting projection 29 is inserted into the first opening 17. The second fitting claw 56 has a second tapered portion 58 which is slidably in contact with the first protruded surface 52 when the second fitting projection 29 is inserted into the first opening 17. The second tapered portion 58 is formed so that the second fitting projection 29 is thinner toward the distal end of the second fitting projection 29. Thus, when the second fitting projection 29 is press-fitted into the first opening 17 while slightly flexing, the first protruded surface 52 slides on the second tapered portion 58, the second fitting claw 56 smoothly passes over the first protruded surface 52, and the second fitting surface 56*a* can be engaged with the first protruded surface 52. Thus, the cover member 3 is prevented from slipping out in the inserting direction of the base member 2.

As described above, in the element housing 4 of the fuse device 50, since the second fitting projection 29 formed on the cover member 3 is inserted into the first opening 17 formed on the first side wall 11 of the base member 2, the resistance to the pressure generated above the surface 2*a* of the base member 2 is improved. Further, in the element housing 4, the second fitting claw 56 formed on the second fitting projection 29 is press-fitted into the first opening 17 formed in the first side wall 11 of the base member 2, and the second fitting surface 56*a* is engaged with the first protruded surface 52, thereby preventing slipping out in the inserting direction which is parallel with the plane of the surface 2*a* of the base member 2. Further, in the element housing 4, the second fitting claw 56 is formed to bulge from the second fitting projection 29 in the direction in which the cover member 3 is vertically separated from the base member 2, and the first protruded surface 52 is formed to bulge from the abutment surface 11*b* in the direction opposite to the second fitting claw 56, thereby enhancing the mutual engagement, and the base member 2 and the cover member 3 can be more reliably prevented from disengaging even when a vertical pressure is produced at the time of blowout of the fuse element 5.

Similarly, the first fitting claw 51 is formed on a surface facing the abutment surface 22*b* when the first fitting projection 18 is inserted into the second opening 28 so as to bulge in the width direction of the first fitting projection 18. Further, the first fitting claw 51 is provided with a first fitting surface 51*a* that passes over and locks the second protruded surface 57 when the first fitting projection 18 is inserted into the second opening 28. The first fitting claw 51 has a first tapered portion 53 which is slidably in contact with the second protruded surface 57 when the first fitting projection 18 is inserted into the second opening 28. The first tapered portion 53 is formed so that the first fitting projection 18 is thinner toward the distal end of the first fitting projection 18. Thus, when the first fitting projection 18 is press-fitted into the second opening 28 while slightly flexing, the second protruded surface 57 slides on the first tapered portion 53, the first fitting claw 51 smoothly passes over the second protruded surface 57, and the first fitting surface 51*a* can be engaged with the second protruded surface 57. Since the configuration and function of the first fitting claw 51 and the second protruded surface 57 are the same as those of the second fitting claw 56 and the first protruded surface 52 described above, the details thereof are omitted.

The fuse device 50 can prevent the cover member 3 from slipping out from the base member 2 in the direction of the inserting direction parallel with the plane of the surface 2*a* by providing at lease one of the base member 2 and the cover member 3 with an opening and protruded surface, forming a fitting claw on the other one, and locking the base member 2 and the cover member each other; preferably, however, by forming the opening and protruded surface, as well as the locking claw in each of the base member 2 and the cover member 3 to achieve mutual locking, the cover member 3 can be prevented from slipping out from the base member 2 more reliably.

It should be noted that, in the fuse device 50, the first and second fitting projections 18 and 29 may abut on the upper surfaces of the first and second protruded surfaces 52 and 57, thereby improving resistance to the upward pressure of the surface 2*a* of the base member 2.

Further, in the fuse device 50, in addition to forming the first and second tapered portions 53 and 58 on the first and second fitting claws 51 and 56 in sliding contact with the first and second protruded surfaces 52 and 57, a tapered portion may be formed on all side edges of the distal end surfaces of the first and second fitting projections 18 and 29. Thus, when the base member 2 and the cover member 3 are assembled, the first and second fitting projections 18, 29 can be smoothly inserted into the first and second openings 17, 28.

Recess

The fuse device 50 may have a recess 60 formed in the inner surface 25*a* of the cover member 3 facing the surface 2*a* of the base member 2 and apart from the fuse element 5 to form an internal space. The recess 60 rapidly increase the temperature thereof when the fuse element 5 is blown, and release expanded air when the air inside the element housing 4 rapidly expands, to depressurize the inside of the element housing 4, and increases the area where the vaporized substance of the melted fuse element 5 adheres to prevent decrease in the insulation resistance due to the continuation of the vaporized substance on the inner surface 25*a* of the cover member 3.

The recess 60 is provided adjacent to a contact portion on the inner surface 25*a* of the cover member 3 which is in thermal contact with the fuse element 5, for example, and forms an internal space between the recess 60 and the low thermal conductivity portion 15 which serves as a melting portion of the fuse element 5. In addition, it is preferable that the internal space formed by the recess 60 is continuous with the groove 26 serving as a melting portion of the fuse element 5.

By forming the recess 60, the fuse device 50 depressurizes the expanded air at the time of blowing of the fuse element 5 with the recess 60, positively deposits the vaporized substance of the fuse element 5 blown at the groove 26 onto the recess 60, and prevents a large amount of the vaporized substance from adhering to and accumulating on the inner surface 25*a* and the groove 26, thereby preventing reduction in insulation resistance between the terminal portions 5*a* and 5*b* of the fuse element 5.

The recess 60 may be formed continuously from the inner surface 25*a* of the cover member 3 to the inner surfaces of the third and fourth side walls 23 and 24 on which the legs 35 are formed, and may be formed continuously from the lower portions of the third and fourth side walls 23 and 24 to the outside. As a result, the fuse device 50 discharges the expanded gas generated when the fuse element 5 is blown through the recess 60, thereby preventing damage to the element housing 4 due to a rapid rise in the internal pressure and detachment from the external circuit board on which the element housing 4 is mounted.

Materials of the Base Member and the Cover Member

In the fuse device 50, as in the fuse device 1 described above, the base member and the cover member are preferably formed of a plastic material having a tracking resistance of 250V or more, and more preferably, the base member 2 and the cover member 3 are formed of a nylon plastic material, particularly, of nylon 46 among the nylon plastic materials. By using this, the fuse device 1 can increase the tracking resistance to 600V or more. Since the structure and function of the base member and the cover member are the same as those of the fuse device 1 described above, the details thereof are omitted.

Heat-Generating Element

Similarly to the fuse device 40 described above, the fuse device 50 may be provided with a heat-generating element 41 on the base member 2. In the fuse device 50, since the configuration and the function of providing the heat-generating element are the same as those of the fuse device 40 described above, the details are omitted.

Flange

Further, the fuse devices 1 and 50 may be provided with a flange 61 projecting outward at lower end edges of both side surfaces of the base member 2 to which the fuse element 5 is fitted. The flange 61 preferably has a structure such that the flange 61 is positioned under a bent portion or an inclined portion of the fuse element 5 connected to the terminal portions 5*a* and 5*b* when the fuse element 5 is fitted to the surface 2*a* of the base member 2.

As a result, in the fuse devices 1 and 50, the terminal portions 5*a* and 5*b* of the fuse element 5 and the bent portions or the inclined portions of the fuse element 5 partially overlap on the flange 61, and even when the blown area of the fuse element 5 expands to the high thermal conductivity portion 14 when the fuse element 5 is blown by an overcurrent, the flange 61 is hooked on the bent portions of the terminal portions 5*a* and 5*b* and the fuse element 5 is prevented from falling off the external circuit board mounted via the terminal portions 5*a* and 5*b*.

REFERENCE SIGNS LIST

1 fuse device, 2 base member, 2*a* surface, 3 cover member, 4 element housing, 5 fuse element, 5*a*, 5*b* terminal, 6 deformation restricting portion, 7 hole, 9 low melting point metal layer, 10 high melting point metal, 11 first side wall, 11*a* fitting recess, 12 groove, 14 high thermal conductivity portion, 15 low thermal conductivity portion, 16 positioning wall, 17 first opening, 17*a* locking step portion, 18 first fitting projection, 19 locking piece, 20 locking claw, 20*a* locking surface, 20*b* sliding surface, 22 second side wall, 22*a* fitting recess, 23 third side wall, 24 fourth side wall, 25 top surface portion, 26 groove, 27 positioning wall, 28 second opening, 28*a* locking step portion, 29 second fitting projection, 30 locking claw, 31*a* locking surface, 31*b* sliding surface, 35 leg, 40 fuse device, 41 heat-generating element, 42 insulating member, 43 first electrode, 44 second electrode, 45 heat-generating element extraction electrode, 47 flux, 48 first heat-generating element electrode, 49 second heat-generating element electrode, 50 fuse device, 51 first fitting claw, 51*a* first fitting claw, 52 first protruded surface, 53 first tapered portion, 56 second fitting claw, 56*a* second fitting surface, 57 second protruded surface, 58 second tapered portion, 60 recess, 61 flange

The invention claimed is:

1. A fuse device comprising:

a base member:

a cover member fitted to the base member and covering a surface of the base member, wherein the surface defines a plane; and a fuse element disposed between the base member and the cover member;

wherein one of the base member and the cover member is provided with a side wall intersecting with the plane of the surface of the base member and including an opening formed therein, and the other of the base member and the cover member is provided with a fitting projection projecting outward from a plane intersecting with the plane of the surface of the base member and fitted into the opening of the side wall, the fitting projection is provided with a fitting claw which bulges in a direction intersecting the direction of insertion into the opening;

the cover member and the base member are configured such that they slide in opposite direction along the plane of the surface when being fitted together; and the opening is provided with a protruded surface for locking the fitting claw.

2. The fuse device according to claim 1, wherein the fitting claw is provided with a tapered portion which is slidably in contact with the protruded surface when inserted into the opening.

3. The fuse device according to claim 1, wherein each of the base member and the cover member is provided with a side wall having the opening formed on one of the opposing sides and the fitting projection provided on the other of the opposing side.

4. The fuse device according to claim 1, wherein the cover member has a recess formed in an inner surface facing the surface of the base member and apart from the fuse element to form an internal space.

5. The fuse device according to claim 1, wherein the fuse element is provided with terminal portions at both ends, and wherein the cover member exposes the terminal portions of the fuse element on a side different from the side provided with the fitting projection and/or the side wall, and is provided with a leg for restricting movement of the terminal portion in the inserting direction or in a direction opposite to the inserting direction.

6. The fuse device according to claim 5, wherein the base member has a flange positioned under a bent portion or an inclined portion of the fuse element connected to the terminal portion.

7. A fuse device comprising:

a base member;

a cover member fitted to the base member and covering a surface of the base member, wherein the surface defines a plane; and a fuse element disposed between the base member and the cover member, wherein one of the base member and the cover member is provided with a side wall intersecting with the plane of the surface of the base member and including an opening formed therein, and the other of the base member and the cover member is provided with a fitting projection projecting outward from a plane intersecting with the plane of the surface of the base member and fitted into the opening of the side wall, wherein the fitting projection is formed with a fitting claw which bulges in a direction intersecting with the insertion direction into the opening, wherein the opening is provided with a protruded surface for locking the fitting claw, the cover member and the base member are configured such that they slide in opposite directions along the plane of the surface when being fitted together, and wherein the fuse device is a surface mounting type fuse device.

8. A fuse device comprising:

a base member;

a cover member fitted to the base member and covering a surface of the base member, wherein the surfaced defines a plane; and a fuse element disposed between the base member and the cover member, wherein one of the base member and the cover member is provided with a side wall intersecting with the plane of the surface of the base member and including an opening formed therein, and the other of the base member and the cover member is provided with a fitting projection projecting outward from a plane intersecting with the plane of the surface of the base member and fitted into the opening of the side wall, wherein the fitting projection is provided with a fitting claw which bulges in a direction intersecting with the insertion direction into the opening, wherein the opening is provided with a protruded surface for locking the fitting claw, the cover member and the base member are configured such that they slide in opposite directions along the plane of the surface when being fitted together, and wherein the fuse element is a laminate including a high melting point metal layer and a low melting point metal layer.

9. The fuse device according to claim 8, wherein the fuse element comprises a covered structure in which a low melting point metal layer as an inner layer is covered with a high melting point metal layer as an outer layer.

10. The fuse device according to claim 8, wherein the low melting point metal layer is composed of Sn or a metal mainly composed of Sn, and the high melting point metal layer is composed of Ag or Cu, or a metal mainly composed of Ag or Cu.

11. The fuse device according to claim 9, wherein the low melting point metal layer is composed of Sn or a metal mainly composed of Sn, and the high melting point metal layer is composed of Ag or Cu, or a metal mainly composed of Ag or Cu.

* * * * *